US008397803B2

(12) United States Patent
Crabb et al.

(10) Patent No.: US 8,397,803 B2
(45) Date of Patent: Mar. 19, 2013

(54) PACKING ELEMENT SYSTEM WITH PROFILED SURFACE

(75) Inventors: James Crabb, Arbrouth (GB); Ronald G. Taylor, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 233 days.

(21) Appl. No.: 12/831,024

(22) Filed: Jul. 6, 2010

(65) Prior Publication Data

US 2012/0006530 A1 Jan. 12, 2012

(51) Int. Cl.
*E21B 33/12* (2006.01)

(52) U.S. Cl. ..... 166/179; 166/129

(58) Field of Classification Search ..... 166/129, 166/179, 136, 133, 186, 188; 277/327, 337, 277/339

See application file for complete search history.

(56) References Cited

U.S. PATENT DOCUMENTS

| | | | | | |
|---|---|---|---|---|---|
| 2,632,514 | A | * | 3/1953 | Fitzpatrick | 166/134 |
| 2,988,148 | A | * | 6/1961 | Conrad et al. | 277/337 |
| 3,036,639 | A | * | 5/1962 | Baker | 277/338 |
| 3,233,676 | A | * | 2/1966 | Lynes | 166/152 |
| 3,282,346 | A | * | 11/1966 | Claycomb | 166/182 |
| 3,339,637 | A | * | 9/1967 | Holden | 166/128 |
| 3,605,886 | A | * | 9/1971 | Cox et al. | 66/85.2 |
| 3,631,927 | A | * | 1/1972 | Young | 166/134 |
| 4,326,588 | A | * | 4/1982 | McStravick | 166/387 |
| 4,427,063 | A | | 1/1984 | Skinner | |
| 4,436,150 | A | | 3/1984 | Barker | |
| 4,438,933 | A | * | 3/1984 | Zimmerman | 277/337 |
| 4,441,721 | A | * | 4/1984 | Harris et al. | 277/342 |
| 4,518,037 | A | | 5/1985 | Youngblood et al. | |
| 4,548,265 | A | * | 10/1985 | Luke | 166/140 |
| 4,611,658 | A | * | 9/1986 | Salerni et al. | 277/337 |
| 4,730,835 | A | * | 3/1988 | Wilcox et al. | 277/342 |
| 4,765,404 | A | * | 8/1988 | Bailey et al. | 166/117.6 |
| 4,809,989 | A | * | 3/1989 | Kernal | 277/337 |

(Continued)

FOREIGN PATENT DOCUMENTS

WO 2009058021 A2 5/2009

OTHER PUBLICATIONS

Foreign communication from a related counterpart application—International Search Report and Written Opinion, PCT/US2011/030789, Sep. 29, 2011, 8 pages.

(Continued)

*Primary Examiner* — Giovanna Wright
*Assistant Examiner* — Michael Wills, III
(74) *Attorney, Agent, or Firm* — Conley Rose, P.C.; Scott F. Wendorf

(57) ABSTRACT

A downhole retrievable dual directional isolation tool, comprising a mandrel, a compressor ring concentric with the mandrel, and a packing element concentric with the mandrel and having an outer surface defining a plurality of grooves. A downhole retrievable dual directional isolation tool, comprising a mandrel, a packing element concentric with the mandrel, a compressor ring concentric with the mandrel and having a first side wall proximate to a second side wall of the packing element, and a stop ring concentric with the mandrel having a third side wall proximate to a fourth side wall of the packing element, wherein the first side wall of the compressor ring or the third side wall of the stop ring have a circumferential land, whereby in a set state of the tool a contact area between the circumferential land and the second side wall of the packing element or the fourth side wall of the packing element achieves higher contact pressure.

26 Claims, 12 Drawing Sheets

U.S. PATENT DOCUMENTS

| | | | | |
|---|---|---|---|---|
| 4,862,967 | A * | 9/1989 | Harris | 166/387 |
| 4,898,239 | A | 2/1990 | Rosenthal | |
| 5,117,913 | A | 6/1992 | Themig | |
| 5,176,217 | A * | 1/1993 | Luke et al. | 166/195 |
| 5,226,494 | A | 7/1993 | Rubbo et al. | |
| 5,311,938 | A * | 5/1994 | Hendrickson et al. | 166/134 |
| 5,431,412 | A * | 7/1995 | Reinhardt et al. | 277/342 |
| 5,542,473 | A * | 8/1996 | Pringle | 166/120 |
| 6,044,908 | A | 4/2000 | Wyatt | |
| 6,446,717 | B1 * | 9/2002 | White et al. | 166/187 |
| 6,691,788 | B1 * | 2/2004 | Dearing | 166/382 |
| 6,843,480 | B2 * | 1/2005 | Nelson et al. | 277/338 |
| 7,210,533 | B2 * | 5/2007 | Starr et al. | 166/376 |
| 7,360,590 | B2 * | 4/2008 | Kossa et al. | 166/119 |
| 7,424,909 | B2 * | 9/2008 | Roberts et al. | 166/118 |
| 7,673,693 | B2 * | 3/2010 | Standridge et al. | 166/387 |
| 7,926,581 | B2 * | 4/2011 | Marshall et al. | 166/387 |
| 8,091,640 | B2 * | 1/2012 | Saltel | 166/285 |
| 2002/0121743 | A1 | 9/2002 | Crow et al. | |
| 2003/0080515 | A1 * | 5/2003 | Milberger et al. | 277/603 |
| 2007/0056725 | A1 * | 3/2007 | Lucas et al. | 166/179 |
| 2008/0115928 | A1 * | 5/2008 | Cherewyk | 166/118 |
| 2008/0179055 | A1 * | 7/2008 | Baski | 166/147 |
| 2008/0190600 | A1 * | 8/2008 | Shkurti et al. | 166/134 |
| 2008/0196884 | A1 * | 8/2008 | Doane et al. | 166/134 |
| 2008/0230236 | A1 | 9/2008 | Wright et al. | |
| 2008/0290602 | A1 | 11/2008 | Coronado | |
| 2009/0242215 | A1 * | 10/2009 | Eatwell et al. | 166/387 |
| 2010/0243235 | A1 * | 9/2010 | Caldwell et al. | 166/118 |
| 2011/0186307 | A1 | 8/2011 | Derby | |
| 2011/0247835 | A1 * | 10/2011 | Crabb | 166/387 |

OTHER PUBLICATIONS

Foreign communication from a related counterpart application—International Search Report and Written Opinion, PCT/US2011/040032, Feb. 9, 2012, 9 pages.

Patent application entitled "Sequenced packing element system," by James Crabb, filed Apr. 12, 2010 as U.S. Appl. No. 12/758,411.

Office Action dated Apr. 30, 2012 (25 pages), U.S. Appl. No. 12/758,411, filed Apr. 12, 2010.

* cited by examiner

PACKING ELEMENT SYSTEM WITH PROFILED SURFACE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Downhole tools and completion strings may use isolation devices and/or pressure barriers such as packers and others for isolating one zone from another or for isolating a plurality of zones. Some isolation tools are designed to maintain a pressure differential in one direction only, which may be referred to as unidirectional pressure barrier tools and/or unidirectional isolation tools. Other isolation tools are designed to maintain a pressure differential in both directions, which may be referred to as dual directional pressure barrier tools and/or dual directional isolation tools. Pressure on seals may be exerted by reservoir pressures, by pressure applied from the surface into an annulus, and by other pressure sources. Pressure may be exerted by liquids and/or gases. Some isolation devices and/or pressure barrier tools are designed to be deployed, to seal, to unseal, and to be retrieved from the wellbore, which may be referred to as retrievable tools.

SUMMARY

Disclosed herein is a downhole retrievable dual directional isolation tool, comprising a mandrel, a compressor ring concentric with the mandrel, and a packing element concentric with the mandrel and having an outer surface defining a plurality of grooves.

Also disclosed herein is a downhole retrievable dual directional isolation tool, comprising a mandrel, a packing element concentric with the mandrel, a compressor ring concentric with the mandrel and having a first side wall proximate to a second side wall of the packing element, and a stop ring concentric with the mandrel having a third side wall proximate to a fourth side wall of the packing element, wherein the first side wall of the compressor ring or the third side wall of the stop ring have a circumferential land, whereby in a set state of the tool a contact area between the circumferential land and the second side wall of the packing element or the fourth side wall of the packing element achieves higher contact pressure.

Further disclosed herein is a downhole retrievable dual directional isolation tool, comprising a mandrel, a packing element having an outer surface defining a plurality of circumferential grooves, wherein the grooves are angled across an axial section of the packing element.

Further disclosed herein is a downhole retrievable dual directional isolation tool, comprising a mandrel, a packing element body concentric with the mandrel and comprising a first elastomeric material having a first hardness, and at least one sealing insert concentric with the mandrel and comprising a second elastomeric material having a second hardness, wherein the second hardness is less than the first hardness.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 2B:
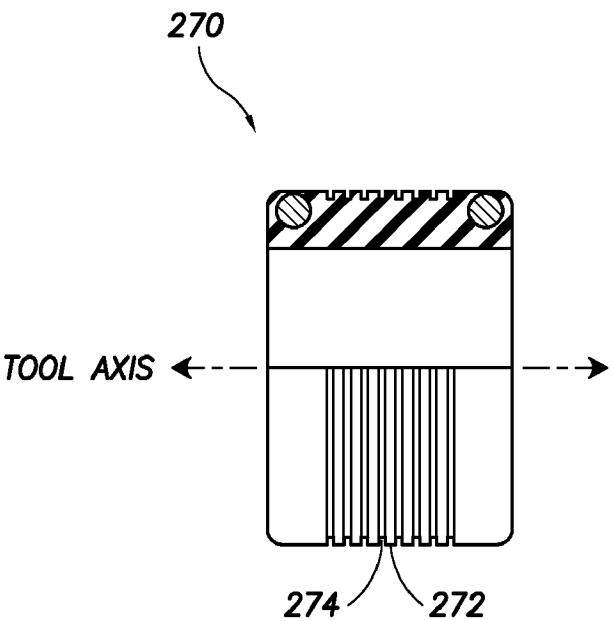
FIG. 2B is an illustration of a packing element in axial section view according to an embodiment of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

Packing elements may be employed in a variety of wellbore servicing operations. Dual directional, removable isolation tools having one or more packing elements may be activated for sealing by compressing the packing element, for example by compressing the packing element between a stop ring and a compressor ring. In some contexts, the stop ring and the compressor ring may be referred to as an upper gauge ring and a lower gauge ring. Activating the packing element by delivering compression force to the packing element may be referred to in some contexts as pack-off. Under some conditions, upon completion of the packing element pack-off, a slight backlash or relaxation of the pack-off may occur. This backlash may reduce the sealing effectiveness of the packing element at one or both ends of the packing element. Under these circumstances, the packing element may seal positively when the fluid and/or gas pressure differential across the packing element has a first sense but may leak when the fluid and/or gas pressure differential across the packing element has an opposite sense. Under some conditions, the packing element may cool over time and shrink as a result of this cooling, again reducing the sealing effectiveness of the packing element. The present disclosure teaches profiling or shaping of packing element surfaces to provide increased surface contact pressure at selected points on the packing element and decreased surface contact pressure at other selected points on the packing element. Additionally or in combination with this concept, the disclosure further teaches providing packing elements having surface areas of restricted sealing or surface areas where sealing is limited. These concepts may also be combined with selective and/or designed flow of formation fluids and/or formation gases past a portion of the packing element surface to an inside diameter of the packing element to activate a different portion of the packing element surface to seal by operation of a pressure differential across a selected and/or designed portion of the packing element.

The sealing effectiveness of a packing element may be related to the contact area to which a contact force is applied. When a packing element is packed-off, the compression force causing the packing element to expand as its axial length (axial with reference to the axis of a mandrel over which the packing element is disposed) is reduced by compression causes the packing element outside diameter surface to apply a contact force to the interior wall of the wellbore and/or a casing. More force applied to the contact area between the packing element and a casing wall, for example, may increase the sealing effectiveness of the isolation tool. Applying the same amount of force but over a diminished contact area between the packing element and the casing wall, for example, may likewise increase the sealing effectiveness of the isolation tool. A packing element having a reduced contact area and/or areas is taught in the following disclosure. Depending on a surface geometry of a packing element, reducing the contact area of the packing element may be employed to restrict sealing over a specific area, that is to reduce the sealing effectiveness over the subject area.

In an embodiment, one or more circumferential insert may be set into a packing element, where the hardness of the circumferential insert is less hard (lower durometer) than the remaining packing element. The circumferential insert may provide increased sealing effectiveness while the harder packing element may at least partially surround and support the circumferential insert.

Figure 1:
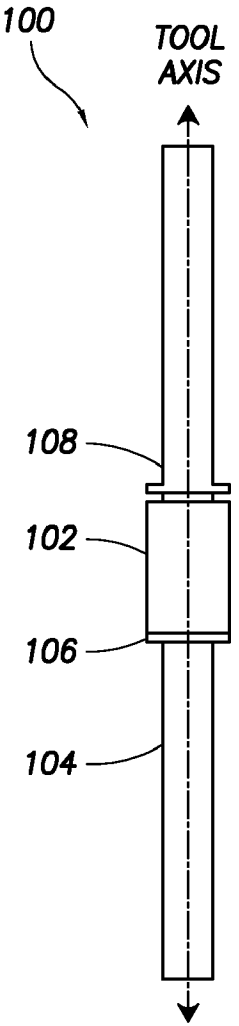
FIG. 1 is an illustration of a packing element according to an embodiment of the disclosure.

Turning now to FIG. 1, a downhole tool 100 is described. The tool 100 comprises a packing element 102, a mandrel 104, a stop ring 106, and a compressor ring 108. In some contexts, the packing element 102 may be referred to as a packer element. In some contexts the tool 100 may be referred to as an isolation tool, a packer, a retrievable packer, a bridge plug, and/or a retrievable bridge plug. The packing element 102 is disposed around the mandrel 104. The compressor ring 108 is concentric with the mandrel 104. It is understood that the tool 100 may comprise other components and structures which are not illustrated in FIG. 1A to avoid cluttering the illustration. The mandrel may extend through the packing element 102 and at least part way into the compressor ring 108. Unless otherwise specified, use of the terms "engage," "couple," and "attach" is not meant to limit the subject interaction to direct interaction between the elements and may also include indirect interaction between the elements described.

In an embodiment, the downhole tool 100 is retrievable by one of a wireline and an electrical line. Those skilled in the art appreciate that retrieving the downhole tool 100 using wireline or electrical line may impose structural limitations on the packing element 102. For example, a tool comprising a packing element 102 that is suitable for retrieving using jointed pipe may not be suitable for retrieving using wireline or electrical line. The packing element 102 is at least partially flexible and swells when compressed by the compressor ring 108 and resumes its former shape, at least partially, when compression forces are removed. In an embodiment, the packing element 102 may comprise rubber, but in other embodiments the packing element 102 may comprise other elastomeric material or materials.

In an embodiment, the packing element 102 comprises an elastomer or a plurality of elastomers. The elastomers may include any suitable elastomeric material that can melt, cool, and solidify onto a high density additive. In an embodiment, the elastomer may be a thermoplastic elastomer (TPE). Without limitation, examples of monomers suitable for use in forming TPEs include dienes such as butadiene, isoprene and hexadiene, and/or monoolefins such as ethylene, butenes, and 1-hexene. In an embodiment, the TPE includes polymers comprising aromatic hydrocarbon monomers and aliphatic dienes. Examples of suitable aromatic hydrocarbon monomers include without limitation styrene, alpha-methyl styrene, and vinyltoluene. In an embodiment, the TPE is a crosslinked or partially crosslinked material. The elastomer may have any particle size compatible with the needs of the process. For example, the particle size may be selected by one of ordinary skill in the art with the benefits of this disclosure to allow for easy passage through standard wellbore servicing devices such as for example pumping or downhole equipment. In an embodiment, the elastomer may have a median particle size, also termed D50, of greater than about 500 microns, alternatively of greater than about 550 microns, and a particle size distribution wherein about 90% of the particles pass through a 30 mesh sieve US series.

In an embodiment, packing element 102 may comprise a resilient material. Herein resilient materials may refer to materials that are able to reduce in volume when exposed to a compressive force and return back to about their normal volume (e.g., pre-compressive force volume) when the compressive force subsides. In an embodiment, the resilient material returns to about the normal volume (e.g., to about 100% of the normal volume) when the compressive force subsides. In an alternative embodiment, the resilient material returns to a high percentage of the normal volume when the compressive force subsides. A high percentage refers to a portion of the normal volume that may be from about 70% to about 99% of the normal volume, alternatively from about 70% to about 85% of the normal volume, and further alternatively from about 85% to about 99% of the normal volume. Such resilient materials may be solids, liquids or gases.

In an embodiment, the packing element 102 is intended to provide a dual directional seal. A dual directional seal, as this term is intended to be construed in this disclosure, is suitable for establishing a seal with a casing wall that blocks flow of either fluid or gases across the seal in either direction, independently of the sense of the pressure differential that may exist between an annulus formed between the tool 100 and the wellbore casing on a first side of the packing element 102 and the annulus on the opposite side of the packing element 102. In an embodiment, the packing element 102 is intended for use to seal in the presence of high gas pressure differentials with zero leakage or very little leakage.

Turning now to FIG. 2A, FIG. 2B, FIG. 2C, FIG. 2D, FIG. 2E, and FIG. 2F a variety of embodiments of packing elements are described. Some of these packing elements define one more grooves on their outer circumferential surface. Others of these packing elements comprise a raised circumferential ridge formed of material with different hardness from the material of the main part of the packing element. Any of these packing elements may share features of the packing element 102 described more fully above and may be used in the place of the packing element 102 in the tool 100 described above with reference to FIG. 1A. The packing elements are disposed concentric with the mandrel 104. The packing elements are at least partially flexible and swell when compressed. In an embodiment, the packing elements may comprise an elastomer or a plurality of elastomers. In an embodiment, the packing elements comprise materials such as those described further above with reference to the packing element 102.

Figure 2A:
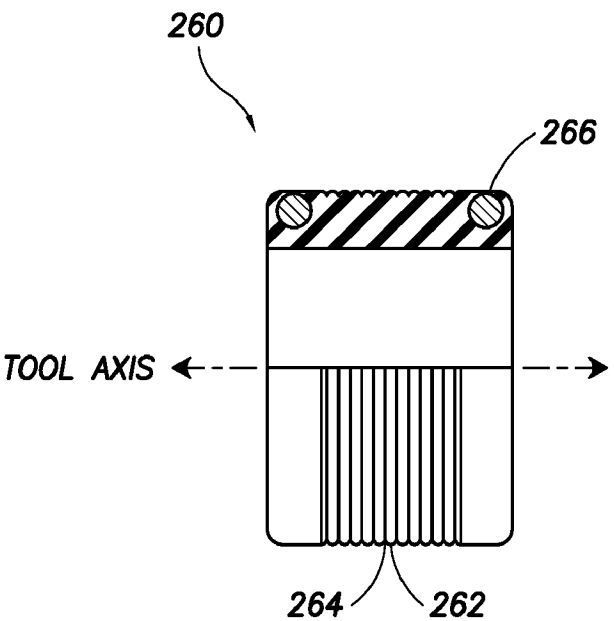
FIG. 2A is an illustration of a packing element in axial section view according to an embodiment of the disclosure.

With reference to FIG. 2A, a packing element 260 is shown comprising a plurality of circumferential lands 262 and defining a plurality of circumferential grooves 264. The grooves 264 defined by the packing element 260 are curved in axial section, as is best seen at the top of FIG. 2A. It may also be said that the lands 262 are curved in axial section. In an embodiment, the lands 262 may be semi-circular in axial section. In another embodiment, the lands 262 may be semi-elliptical in axial section.

In an embodiment, the land 262 may be a circumferentially continuous ridge. As used herein, the term 'land' is used to refer to a surface structure of the packing element that projects above surrounding grooves or channels. The outside diameter of the packing element at the peak of the land may be substantially the same as the outside diameter of the packing element outside of the region of lands and grooves. Alternatively, in some embodiments, the outside diameter of the packing element at the peak of the land may be different from the outside diameter of the packing element outside the region of lands and grooves. In an embodiment, the groove 264 may be a circumferentially continuous groove or channel. The outside diameter of the packing element at the bottom of the groove is less than the outside diameter of the packing element at the peak of the land. The packing element 260 may be formed by cutting or milling the grooves 264 out of the outer circumferential surface of a smooth surfaced packing element. Alternatively, the packing element 260 may be formed by molding to have the pattern of lands 262 and grooves 264. In an embodiment, the packing element 260 may comprise an anti-extrusion mechanism 266, for example two circumferential anti-extrusion rings. In an embodiment, the anti-extrusion rings may expand with the expansion of the packing element 260 when compressed.

The force exerted on a surface can be related to a contact pressure and a contact surface area as $$F \propto PA \quad \text{(Eq 1)}$$

$$P \propto F/A \quad \text{(Eq 2)}$$

where F is a force applied normally to the surface, A is the area of the contact, and P is the contact pressure exerted on the surface expressed as pressure per unit area. Eq 1 expresses force as directly proportional to both contact pressure and contact surface area. Eq 2 rearranges Eq 1 by a simple algebraic operation to express contact pressure as directly proportional to force and indirectly proportional to contact area. Worded alternatively, Eq 2 expresses pressure as directly proportional to both force and the reciprocal of contact area. It will be appreciated that the above proportional relations may be transformed to express equalities by use of an appropriate multiplicative constant of proportionality to account for units. In the SI system of units, no constant of proportionality is needed, or the constant is unity, provided force is expressed in units of Newtons, contact pressure is expressed in units of Pascals, and contact area is expressed in units of square meters.

A predetermined compression force may be applied to the packing element 260 by an isolation tool, for example the stop ring 106 and the compressor ring 108 of the tool 100. This predetermined compression force may be said to result in a predetermined force applied to the casing wall by the outer circumferential surface of the packing element 260, as the packing element 260 swells in response to the compression force. When a fixed or predetermined force is applied to a casing wall by the outer circumferential surface of the packing element 260, the contact pressure between the packing element and the casing wall may be said to increase with reference to a similar sized smooth surfaced packing element because the outer circumferential surface area of the packing element 260—term A in Eq 2 above—has been reduced with reference to the surface area of the smooth surfaced packing element by the grooves 264. It is known to those of skill in the art that increased contact pressure between a packing element and a casing wall may be associated with more effective sealing, for example sealing against flow of high pressure gas.

With reference to FIG. 2B, a packing element 270 is shown comprising a plurality of circumferential lands 272 and defining a plurality of circumferential grooves 274. The grooves 274 defined by packing element 270 are rectangular in axial section, as is best seen at the top of FIG. 2B. It may also be said that the lands 272 are rectangular in axial section. With the exception of the different geometry of their respective grooves 264, 274 and their respective lands 262, 272, the packing element 270 is substantially similar to the packing element 260, and the characterization of packing element 260 is substantially applicable to packing element 270. In an embodiment, the top of the lands 272 may be flat and the grooves 274 may be curved.

Figure 2D:
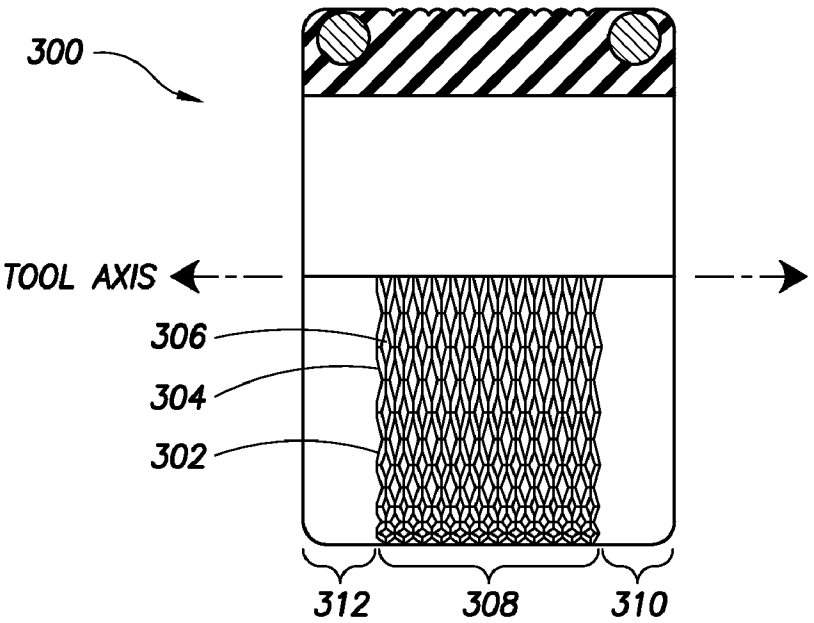
FIG. 2D is an illustration of a packing element in axial section view according to an embodiment of the disclosure.
Figure 2C:
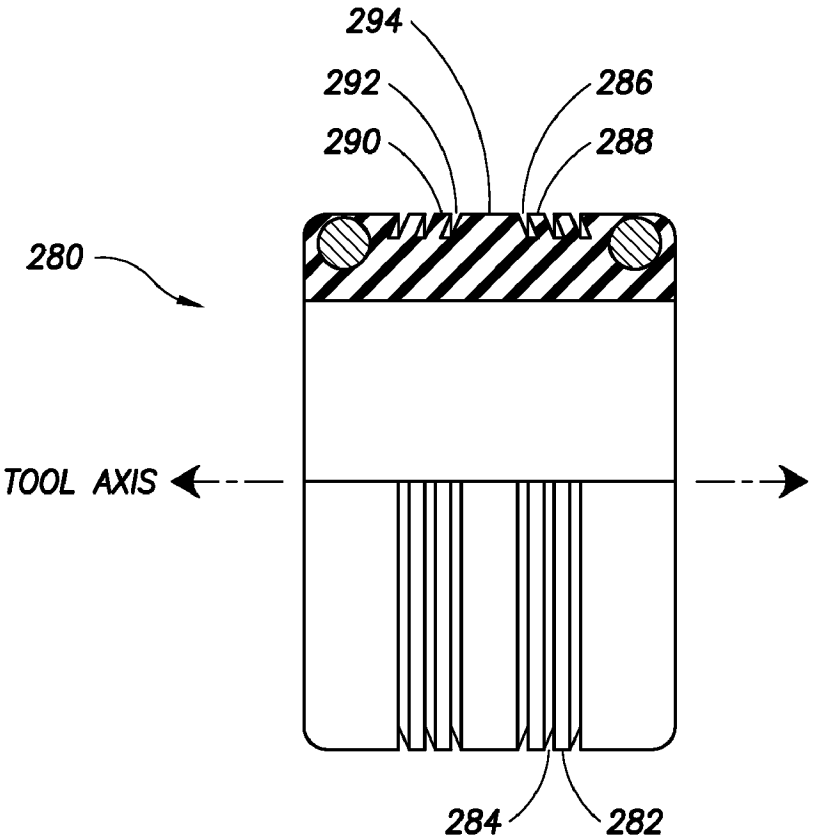
FIG. 2C is an illustration of a packing element in axial section view according to an embodiment of the disclosure.

With reference to FIG. 2C, a packing element 280 is shown comprising a plurality of circumferential lands 282 and defining a plurality of circumferential grooves 284. The grooves 284 defined by packing element 280 are a non-rectangular parallelogram in axial section, as best seen at the top of FIG. 2C. It may also be said that, in an embodiment, the lands 282 are a non-rectangular parallelogram in axial section. In an embodiment, the packing element 280 comprises an intermediate land 294 that is rhomboid in axial section. In an embodiment, the intermediate land 294 separates a plurality of grooves 286 and one or more lands 288 on a first side of the intermediate land 294 from a plurality of grooves 292 and one or more lands 290 on a second side of the intermediate land 294.

In an embodiment, the grooves 286, 292 and the lands 288, 290 slant towards the intermediate land 294 from an inner diameter to an outer diameter of the packing element 280. In some contexts, this disposition of lands 288, 290 and grooves 286, 292 may be referred to as a chevron pattern or a chevron configuration. Alternatively, in another embodiment, the grooves 286, 292 and the lands 288, 290 may slant away from the intermediate land 294. Alternatively, in still another embodiment, the grooves 286, 292 and the lands 288, 290 may all slant leftwards or may all slant rightwards. In an embodiment, the intermediate land 294 may define a form other than a rhomboid form in axial section.

As depicted in FIG. 2C, the slanting of the lands 288 may promote increasing the contact pressure between the outer axial surface of the lands 288 with the casing wall, and hence increasing their sealing effectiveness, when the pressure differential applied to the packing element 280 is directed in the sense from left to right. Likewise, the slanting of the lands 290 may promote increasing the contact pressure between the outer axial surface of lands 290 with the casing wall, and hence increasing their sealing effectiveness, when the pressure differential applied to the packing element 280 is directed in the sense from right to left. Either of these circumstances may be referred to as pressure activation of the lands 288 and/or pressure activation of slanted lands. With the exception of the different geometry of their respective grooves 264, 286, 292 and their respective lands 262, 288, 290, 294, the packing element 280 is substantially similar to the packing element 260, and the characterization of packing element 260 is substantially applicable to packing element 280.

While FIG. 2C illustrates the number of lands 288 on the first side of the intermediate land 294 as being equal to the number of lands 290 on the second side of the intermediate land 294, in an embodiment these numbers may be different. Likewise, while FIG. 2C illustrates the number of grooves 286 on the first side of the intermediate land 294 as being equal to the number of grooves 292 on the second side of the intermediate land 294, in an embodiment, these numbers may be different. In an embodiment, a greater number of lands 290 may be employed on the second side of the intermediate land 294 than the number of lands 288 employed on the first side of the intermediate land 294 when the compression force applied by the compressor ring 108 are applied to the left side of the packing element 280 and the force is directed to the right in FIG. 2C. This may promote compensating against a reduced sealing effectiveness on the right side of the packing element 280 that may result from uneven distribution of compression forces into the packing element 280, as described more fully above, for example where gas or fluid may leak past lands 288, 294 and provide activating force against the lands 290.

With reference to FIG. 2D, a packing element 300 is shown comprising a plurality of diamond shaped lands 306 and defining a plurality of first parallel grooves 302 and a plurality of second parallel grooves 304. The area of diamond shaped lands 306 may be referred to as a first circumferential surface 308. The first parallel grooves 302 intersect the second parallel grooves 304 in a lattice-like pattern. With the exception of the different geometry of their respective grooves 264, 302, 304 and their respective lands 262, 306, the packing element 300 is substantially similar to the packing element 260, and the characterization of packing element 260 is substantially applicable to packing element 300. Bearing in mind that none of the lands 306 forms a continuous circumferential ridge, it will be appreciated that the grooves 302, 304 may provide areas of lowered contact pressure and hence paths for gas and/or fluid to propagate. The first circumferential surface 308 may be said to restrict or limit sealing effectiveness, which may be desired in some contexts. It is a teaching of the present disclosure that improved sealing in a packing element may be achieved by designing a packing element to provide increased contact pressure in some surface areas, to provide decreased contact pressure in other surface areas, and to provide other surface areas of restricted sealing effectiveness. In an embodiment, a second circumferential surface 310 and a third circumferential surface 312 of the packing element 300 may experience increased sealing effectiveness due to the reduced surface area of the first circumferential band 308. In an embodiment, a circumferential land (not shown) may be located within the first circumferential surface 308 to provide a circumferential band of increased contact pressure and hence increased sealing effectiveness.

In some contexts, the first circumferential surface 308 may be referred to as a knurled surface or a roughened surface. In an embodiment, the first circumferential surface 308 may be formed not of intersecting striations of parallel grooves but instead may be formed of a plurality of scallops and/or cuts into the material of the packing element 300 that generally promote the reduction of contact area and decreased or limited sealing effectiveness. Alternatively, in an embodiment, the packing element 300 having such a first circumferential surface 308 may be fabricated by molding in a mold corresponding to the plurality of scallops and/or cuts.

Figure 2F:
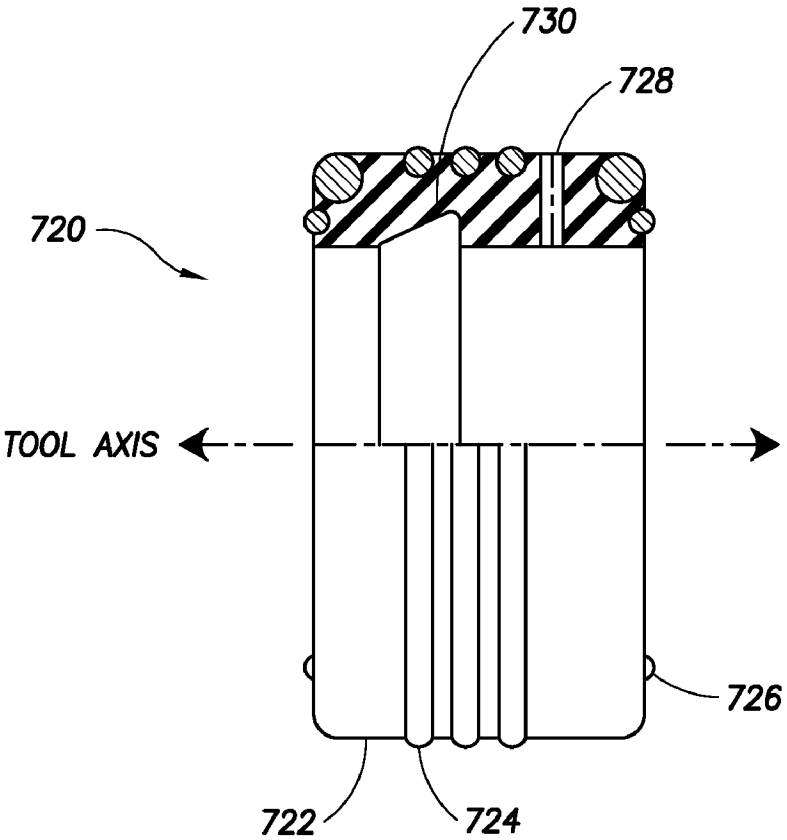
FIG. 2F is an illustration of a packing element in axial section view according to an embodiment of the disclosure.
Figure 2E:
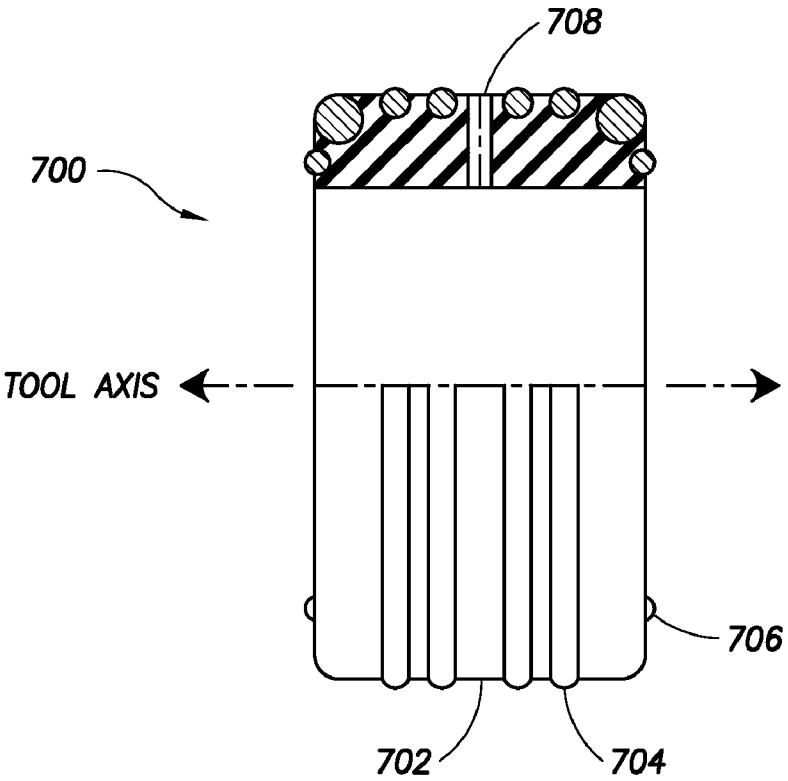
FIG. 2E is an illustration of a packing element in axial section view according to an embodiment of the disclosure.

With reference to FIG. 2E, a packing element 700 is shown comprising a packing element body 702, a first outer surface embedded circumferential ridge 704, a first side wall embedded circumferential ridge 706, and a vent hole 708. The packing element 700 is also shown comprising a second, a third, and a fourth outer surface embedded circumferential ridges and a second side wall embedded circumferential ridge that are illustrated but not labeled. The packing element body 702 may be formed of a first elastomeric material having a first hardness. The packing element 702 may define one or more vent holes 708. Additionally, in an embodiment, the packing element 702 may define a plurality of grooves (not shown) for receiving the outer surface embedded circumferential ridges. In an embodiment, the outer surface embedded circumferential ridges may be retained in the grooves by adhesives or by partial fusing between the material of the packing element 702 and the material of the outer surface embedded circumferential ridges. Alternatively, in an embodiment, the outer surface embedded circumferential ridges are retained in the grooves by elastic tension. The packing element 702 may define one a plurality of circumferential sidewall grooves (not shown) for receiving the side wall embedded circumferential ridges. In an embodiment, the side wall embedded circumferential ridges may be retained in the circumferential side wall grooves by adhesives or by partial fusing between the material of the packing element 702 and the material of the side wall embedded circumferential ridges.

The outer surface embedded circumferential ridges, for example ridge 704, and the side wall embedded circumferential ridges, for example ridge 706, may be formed of a second elastomeric material having a second hardness, where the second hardness is less than or equal to the first hardness. In an embodiment, the first hardness may vary over the range from about 85 Durometer hardness to 100 Durometer hardness. In an embodiment, the second hardness may vary over the range from about 70 Durometer hardness to about 85 Durometer hardness. The greater hardness and/or greater resilience of the packing element body 702 may promote better recovery and anti-extrusion characteristics of the packing element. Additionally, the greater hardness of the packing element body 702 may provide increased support for the outer surface embedded ridges and the side wall embedded ridges. The outer surface embedded ridges and the side wall embedded ridges may promote improved sealing effectiveness. The outer surface embedded ridges and the side wall embedded ridges may be referred to as sealing inserts or inserts in some contexts. While illustrated in FIG. 2E as circular in cross section, the sealing inserts may have any cross section geometry.

With reference to FIG. 2F, a packing element 720 is shown comprising a packing element body 722, a first outer surface embedded circumferential ridge 724, a first side wall embedded circumferential ridge 726, a vent hole 728, and an interior circumferential groove 730. The packing element 720 is also shown comprising a second, a third, and a fourth outer surface embedded circumferential ridges and a second side wall embedded circumferential ridge that are illustrated but not labeled. The packing element 720 shares many elements and properties with the packing element 700 described with reference to FIG. 2E. Unlike the packing element 700, the outer surface embedded circumferential ridges of the packing element 720 are disposed asymmetrically with reference to the tool axis. Described in other words, a longitudinal center of the outer surface embedded circumferential ridges is displaced from a longitudinal center of the packing element body 722. The asymmetrical structure of the packing element 720 may provide enhanced sealing in some downhole environments where a single sense of pressure differential may be expected, for example a pressure differential oriented from right to left with reference to FIG. 2F. In an embodiment, formation fluid pressure and/or formation gas pressure may pass from an outer diameter of the packing element 720 to an inner diameter of the packing element 720 via the vent hole 728, may flow to the interior circumferential groove 730, may partially expand the groove 730, thereby increasing the contact force between the outer surface embedded circumferential ridges and a casing wall, thereby increasing sealing effectiveness when the pressure differential is oriented from right to left with reference to FIG. 2F.

Figure 3B:
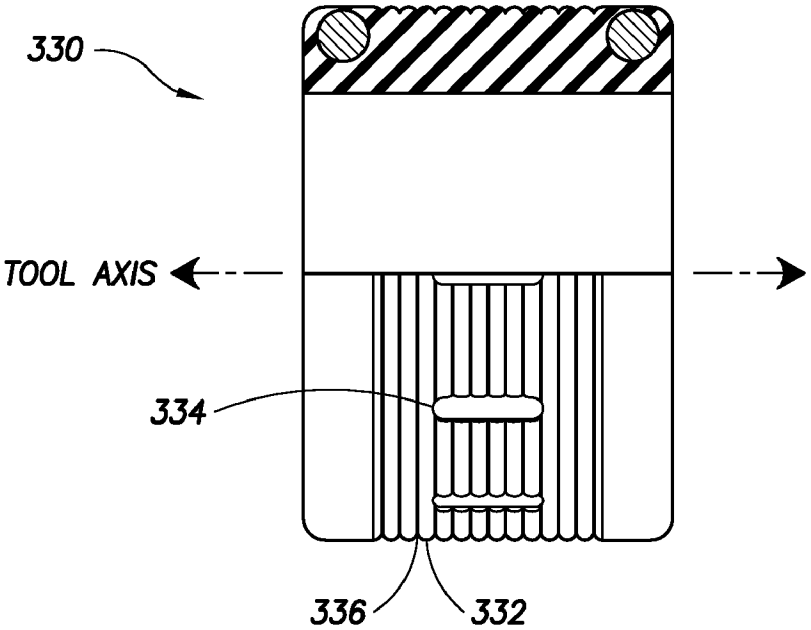
FIG. 3B is an illustration of a packing element in axial section view according to an embodiment of the disclosure.
Figure 3A:
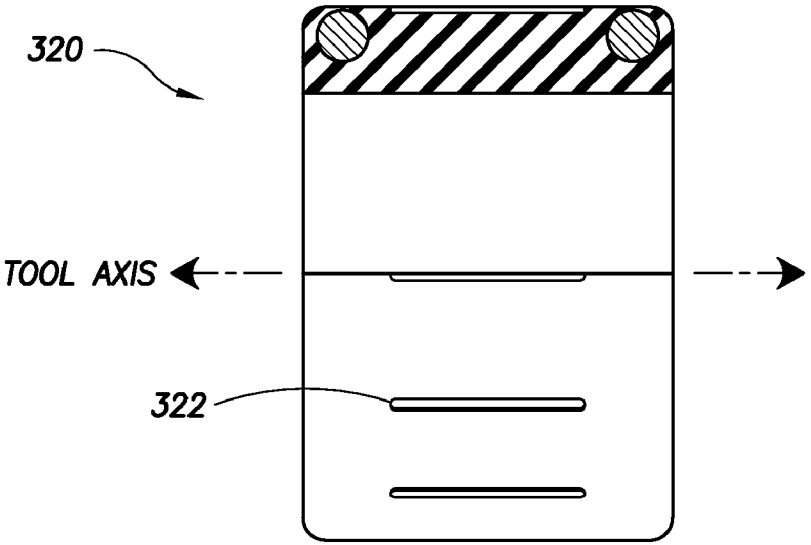
FIG. 3A is an illustration of a packing element in axial section view according to an embodiment of the disclosure.

Turning now to FIG. 3A and FIG. 3B, a plurality of packing elements are described. Any of these packing elements may share features of the packing element 102 described more fully above and may be used in the place of the packing element 102 in the tool 100 described above with reference to FIG. 1 A. The packing elements are disposed concentric with the mandrel 104. The packing elements are at least partially flexible and swell when compressed. In an embodiment, the packing elements may comprise an elastomer. In an embodiment, the packing elements comprise materials such as those described further above with reference to the packing element 102.

With reference to FIG. 3A, a packing element 320 is shown defining a plurality of axial grooves 322. The grooves 322 may be cut into or molded into the packing element 320. The grooves 322 may prevent axial sealing in a middle circumferential area of the packing element 320, promoting flow of formation fluid pressure and/or formation gas pressure. With reference to FIG. 3B, a packing element 330 is shown comprising a plurality of circumferential lands 332 and defining a plurality of axial grooves 334 and a plurality of circumferential grooves 336. While the circumferential lands 332 and the circumferential grooves 336 are illustrated in FIG. 3B as being curved in axial section, the circumferential lands 332 and the circumferential grooves 336 may also be rectangular in axial section. The grooves 334 and 336 may be cut into or molded into the packing element 330.

Figure 4:
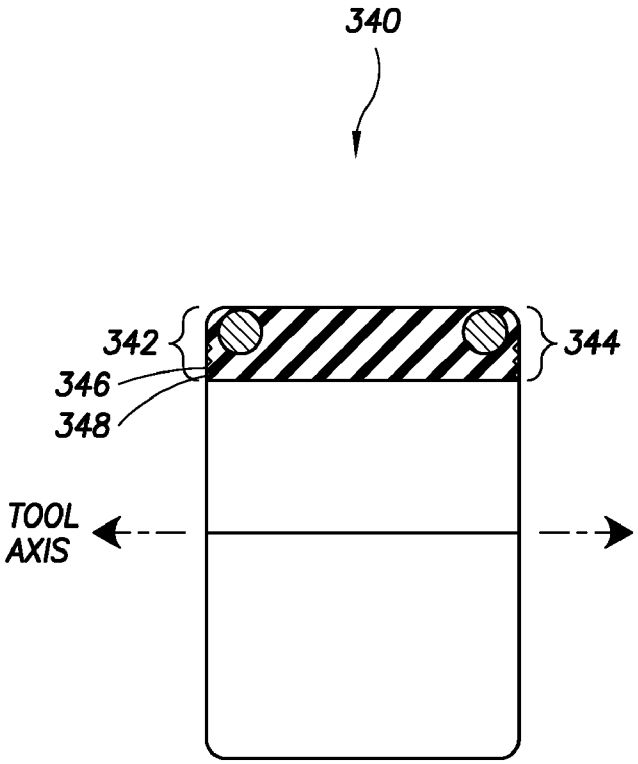
FIG. 4 is an illustration of a packing element in axial section view according to an embodiment of the disclosure.

Turning now to FIG. 4, a packing element 340 having a first side wall 342 and a second side wall 344 is described. The packing element 340 may share features of the packing element 102 described more fully above and may be used in the place of the packing element 102 in the tool 100 described above with reference to FIG. 1A. The packing element 340 is disposed concentric with the mandrel 104. The packing element 340 is at least partially flexible and swells when compressed. In an embodiment, the packing element 340 may comprise an elastomer. In an embodiment, the packing element 340 comprises materials such as those described further above with reference to the packing element 102.

The side walls 342, 344 comprise a plurality of circumferential lands 346 and define a plurality of circumferential grooves 348. While shown in FIG. 4 having lands 346 and grooves 348 with a curved cross section, in an embodiment, the lands 346 and grooves 348 may have other geometries. The grooves 348 may be cut into or molded into the side walls 342, 344. The grooves 348 reduce the contact surface area of the side walls 342, 344, relative to a packing element having smooth side walls, increases the contact pressure with a surface impinging on the side walls (for example gauge rings), and hence increases the sealing effectiveness of the side walls.

Turning now to FIG. 5A, FIG. 5B, FIG. 5C, FIG. 5D, FIG. 5E, and FIG. 5F, a plurality of sub-components of an isolation tool are described. The packing elements of FIG. 5A, FIG. 5B, FIG. 5C, FIG. 5D, FIG. 5E, and FIG. 5F may share features of the packing element 102 described more fully above and may be used in the place of the packing element 102 in the tool 100 described above with reference to FIG. 1A. The packing elements are disposed concentric with the mandrel 104. The packing elements are at least partially flexible and swells when compressed. In an embodiment, the packing elements may comprise an elastomer. In an embodiment, the packing elements comprise materials such as those described further above with reference to the packing element 102.

Figure 5A:
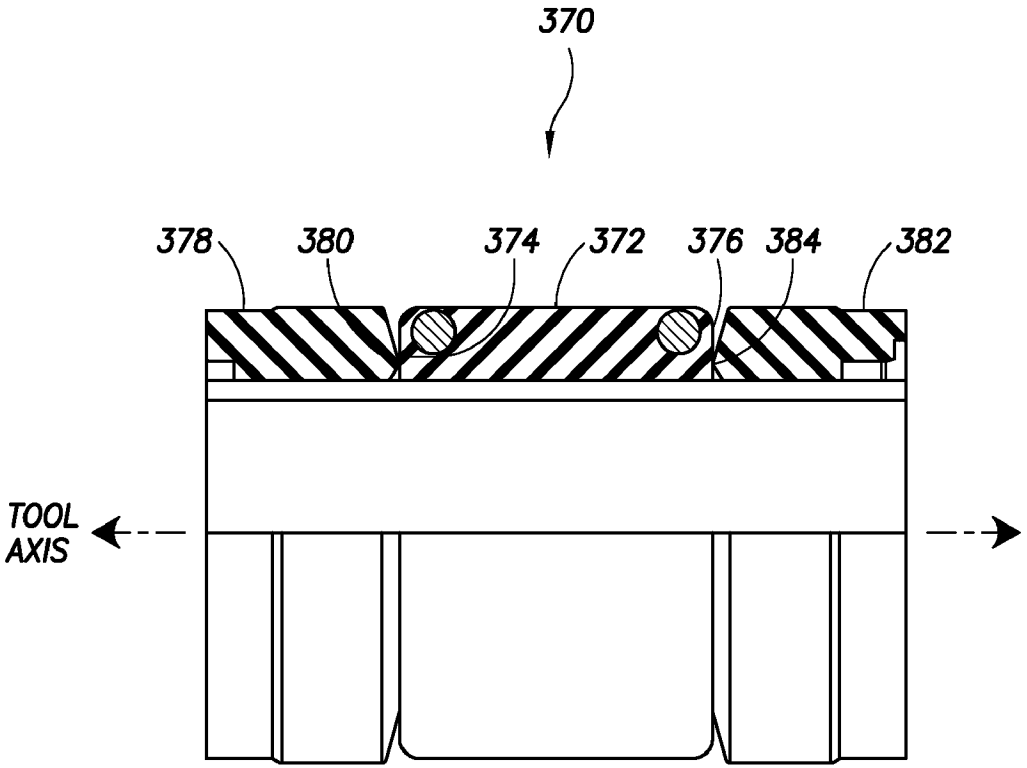
FIG. 5A is an illustration of a packing element in axial section view according to an embodiment of the disclosure.

With reference to FIG. 5A, an isolation tool sub-component 370 is shown comprising a packing element 372 having a first side wall 374 and a second side wall 376, a first gauge ring 378 having a first circumferential ridge 380, and a second gauge ring 382 having a second circumferential ridge 384. When the packing element 372 is expanded, the gauge rings 378, 382 squeeze the side walls 374, 376 towards each other. The ridges 380, 384 form points of increased contact pressure with sidewalls 374, 376, respectively, thereby promoting increased sealing effectiveness of the seal between the gauge rings 378, 382 and the side walls 374, 376. In some contexts, the ridges 380, 384 may be said to establish designed enhanced contact pressure zones when engaged with the packing element 372. In an alternative embodiment, one of the gauge rings 378, 382 has no ridge and has a side wall proximate to the packing element 372 that slopes outwards from an inner diameter to an outer diameter of the subject gauge ring 378, 382.

The sub-component 370 is disposed concentric with the mandrel 104 of the downhole tool 100. In an embodiment, the first gauge ring 378 is disposed between the compressor ring 108 and the packing element 372, and the second gauge ring 382 is disposed between the stop ring 106 and the packing element 372. The stop ring 106 stops the second gauge ring 382, and the second gauge ring 382 stops the packing element 372. The compressor ring 108 applies force to the first gauge ring 378, and the first gauge ring 378 transfers the compression force to the packing element 372. Alternatively, in an embodiment, the first gauge ring 378 is the same device as the compressor ring 108 or provides the functionality of the compressor ring 108, and the second gauge ring 382 is the same device as the stop ring 106 or provides the functionality of the stop ring 106. The gauge rings 378, 382 may be fabricated from metal or non-metallic material. The faces of the ridges 380, 384 may be smooth, for example lapped and/or polished, to promote effective sealing and/or to avoid cutting the side-walls 374, 376.

Figure 5B:
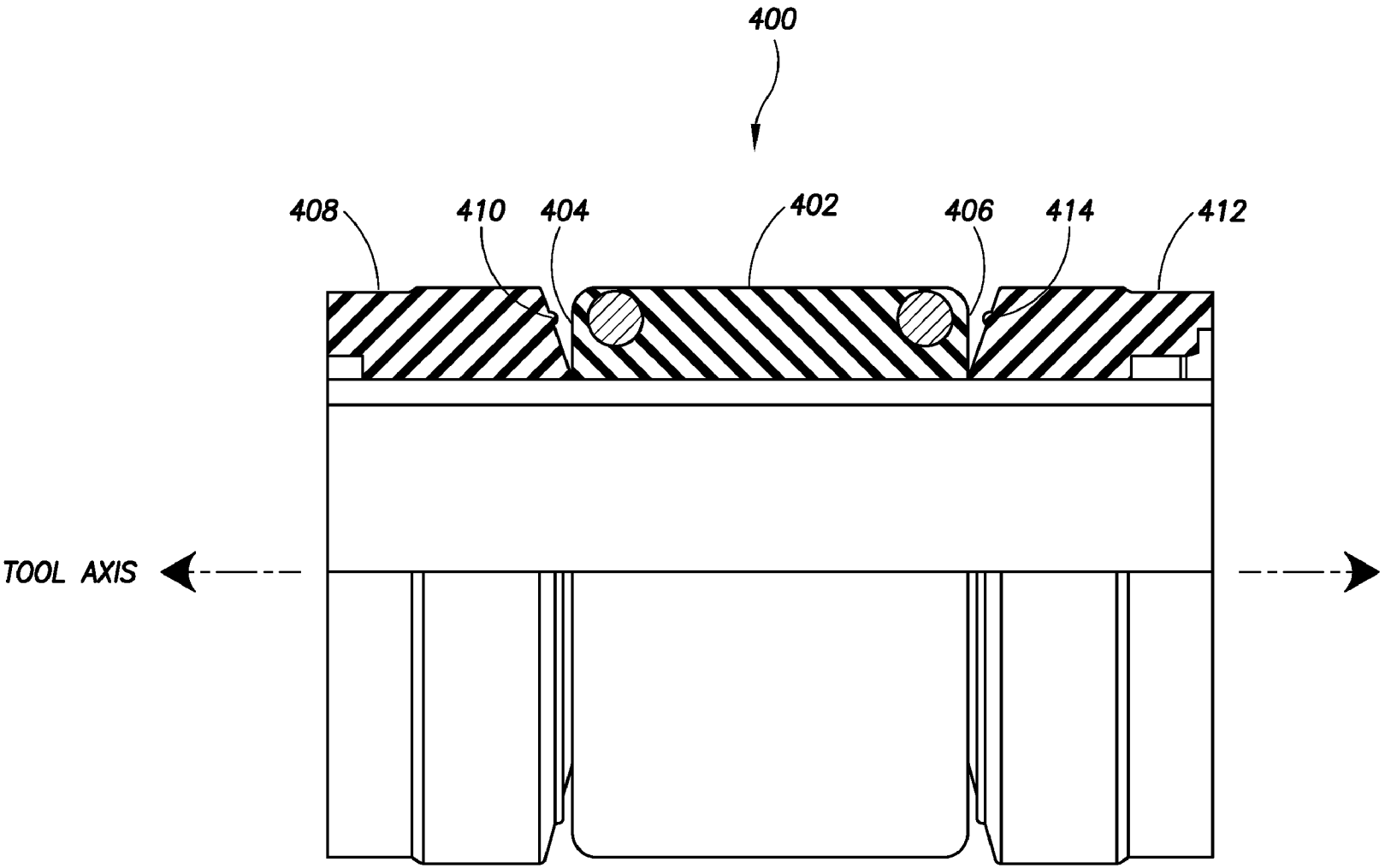
FIG. 5B is an illustration of a packing element in axial section view according to an embodiment of the disclosure.

With reference to FIG. 5B, an isolation tool sub-component 400 is shown comprising a packing element 402 having a first side wall 404 and a second side wall 406, a first gauge ring 408 having a first circumferential ridge 410, and a second gauge ring 412 have a second circumferential ridge 414. The first ridge 410 and the second ridge 414 are curved in axial section. The ridges 410, 414 in axial section may take the form of semi-circles, semi-ellipses, portions of parabolas, portions of hyperbolas, or portions of other curved forms. In some contexts, the ridges 410, 414 may be said to establish designed enhanced contact pressure zones when engaged with the packing element 402. The side faces of the gauge rings 408, 412 proximate to the packing element 402 slope away from the packing element 402 from an inner diameter to an outer diameter of the gauge rings 408, 412. In an alternative embodiment, one of the gauge rings 408, 412 has no ridge and has a side wall proximate to the packing element 402 that slopes outwards from an inner diameter to an outer diameter of the subject gauge ring 408, 412. With the exception of the differences identified between the ridges 380, 384 and the ridges 410, 414, the description of the sub-component 370 substantially applies to the sub-component 400.

Figure 5C:
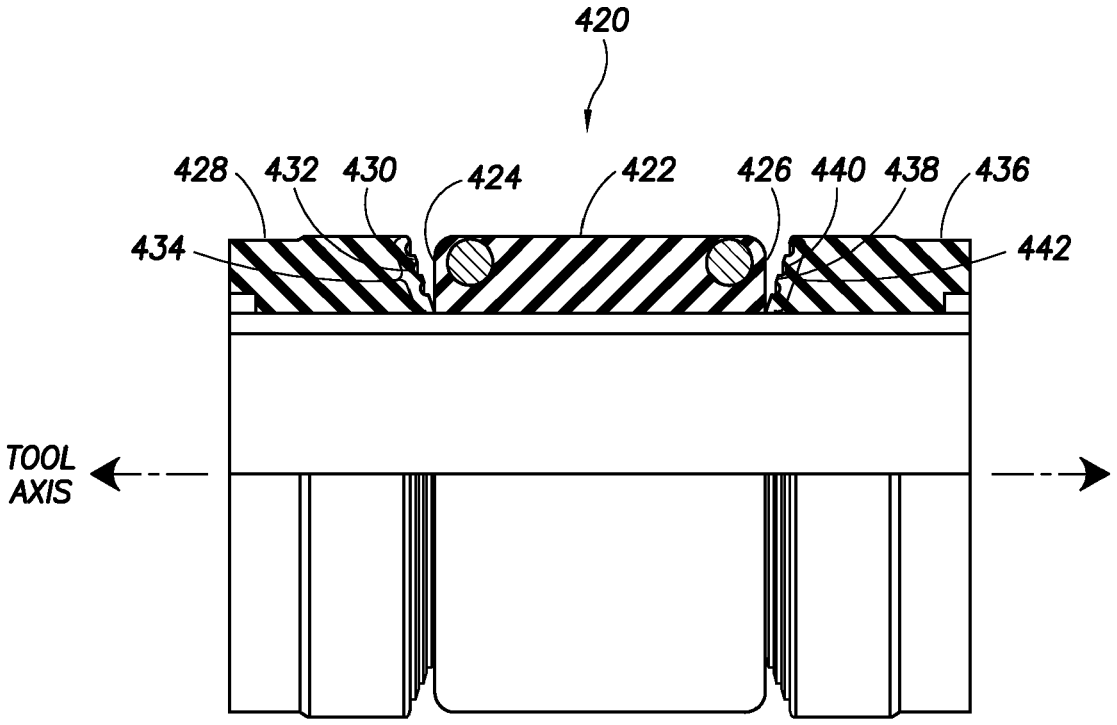
FIG. 5C is an illustration of a packing element in axial section view according to an embodiment of the disclosure.

With reference to FIG. 5C, an isolation tool sub-component 420 is shown comprising a packing element 422 having a first side wall 424 and a second side wall 426, a first gauge ring 428 comprising a plurality of circumferential lands 430 and defining at least one circumferential groove 432 on a third side wall 434 proximate to the first side wall 424, and a second gauge ring 436 comprising a plurality of circumferential lands 438 and defining at least one circumferential groove 440 on a fourth side wall 442. The grooves 432, 440 are curved in axial cross section. The tops of the lands 430, 438 are flat. In another embodiment, however, the tops of the lands 430, 438 may be curved, for example defining a semi-circle, semi-ellipse, or other curved figure when viewed in axial cross section. The reduction of contact surface area in the side walls 434, 442 due to the grooves 432, 440 promotes enhanced sealing effectiveness between the first side wall 424 with the third side wall 434 and between the second side wall 426 and the fourth side wall 442. In an embodiment, one of the gauge rings 428, 436 does not have lands and grooves in its side walls. With the exception of the lands 430, 438 and grooves 432, 440 of the sub-component 420, the description of the sub-component 400 substantially applies to the sub-component 420.

Figure 5D:
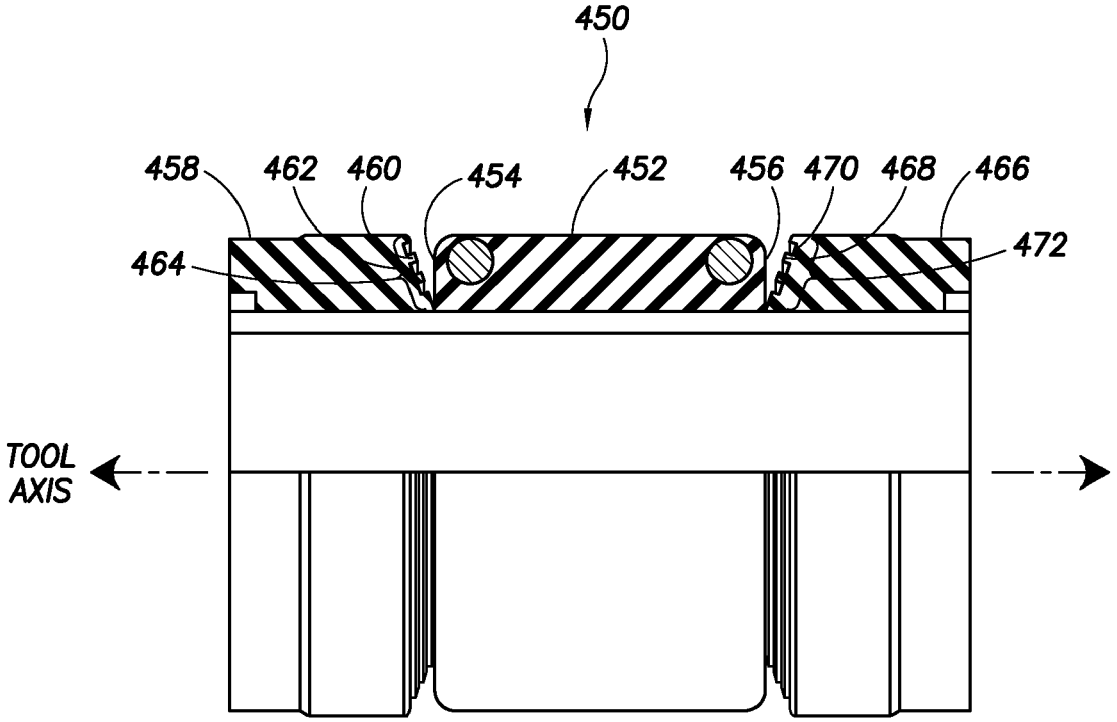
FIG. 5D is an illustration of a packing element in axial section view according to an embodiment of the disclosure.

With reference to FIG. 5D, an isolation tool sub-component 450 is shown comprising a packing element 452 having a first side wall 454 and a second side wall 456, a first gauge ring 458 comprising a plurality of circumferential lands 460 and defining at least one circumferential groove 462 on a third side wall 464 proximate to the first side wall 454, and a second gauge ring 466 comprising a plurality of circumferential lands 468 and defining at least one circumferential groove 470 on a fourth side wall 472. The lands 460, 468 and the grooves 462, 470 are rectangular in axial cross section. Alternatively, in an embodiment, the lands 460, 468 and the grooves 462, 470 may define a rhomboid or parallelogram axial cross section. Alternatively, in an embodiment, the lands 460, 470 may be semicircular, elliptical, or another curved shape. The tops of the lands 460, 468 are flat. In an alternative embodiment, the tops of the lands 460, 468 may be radiused and/or curved. With the exception of the lands 460, 468 and grooves 462, 470 of the sub-component 450, the description of the sub-component 420 substantially applies to the sub-component 450.

Figure 5E:
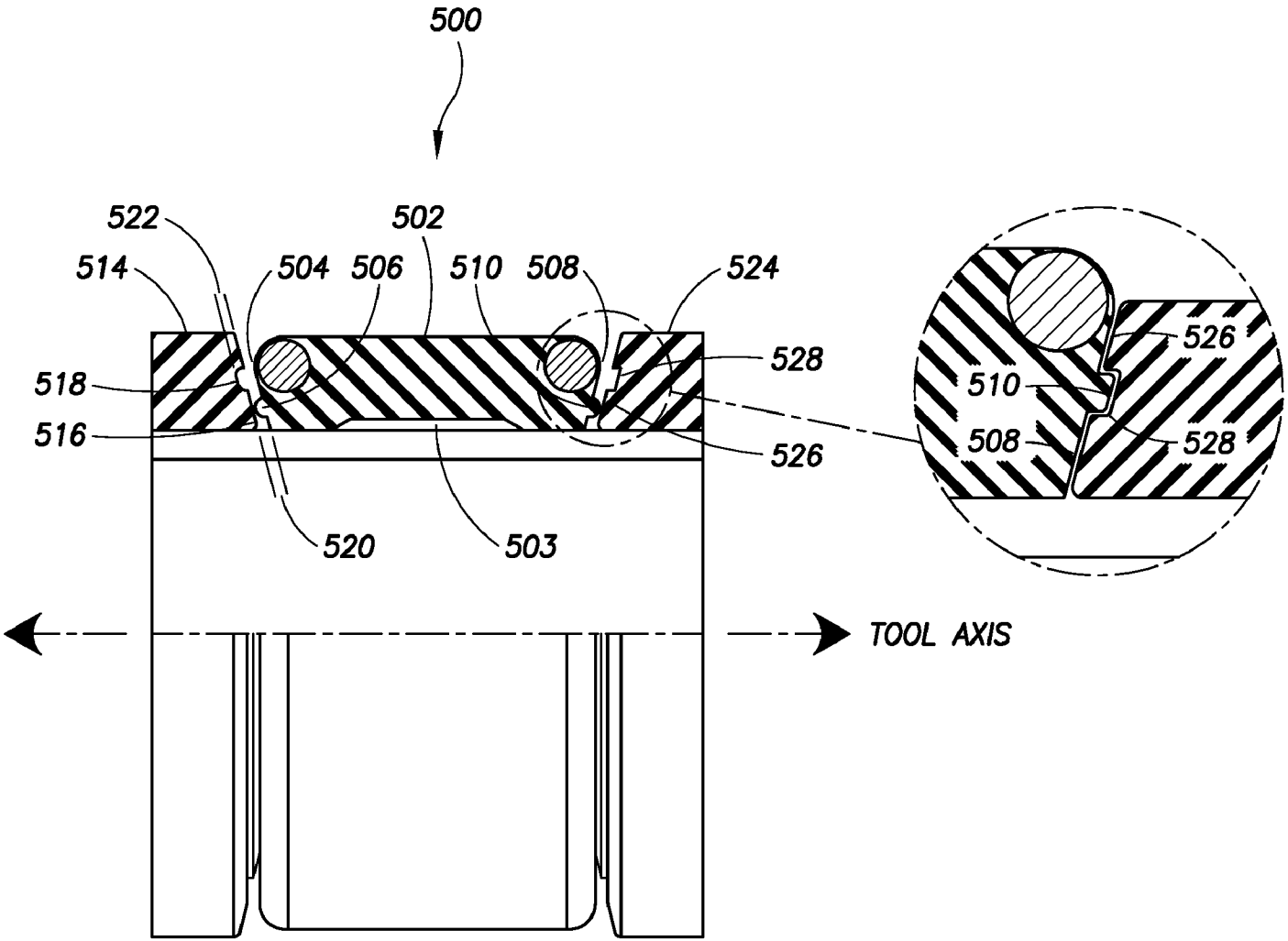
FIG. 5E is an illustration of a packing element in axial section view according to an embodiment of the disclosure.

With reference to FIG. 5E, an isolation tool sub-component 500 is shown. The sub-component 500 comprises a packing element 502 defining a first circumferential groove 503 and having a first side wall 504 comprising a first circumferential ridge 506 and a second side wall 508 comprising a second circumferential ridge 510. In an embodiment, the circumferential ridges 506, 510 may be integral with the packing element 502, for example the ridges 506, 510 may be molded as part of the packing element 502. The packing element may be cut from an elastomeric material blank leaving the circumferential ridges 506, 510. Alternatively, the circumferential ridges 506, 510 may be embedded in side wall circumferential grooves (not shown) of the packing element and may be adhered in the grooves. In an embodiment, the circumferential ridges 506, 510 may be formed of a different elastomeric material than the packing element 502 and may have a reduced hardness relative to the hardness of the packing element 502. The sub-component 500 further comprises a first gauge ring 514 comprising a third side wall 516 defining a second circumferential groove 518.

In a run in condition, the first side wall 506 and the third side wall 516 are separated by a gap 520. The first ridge 506 projects from the first side wall 504 by a distance substantially equal to the gap 520. The second groove 518 has a depth 522. The depth 522 is less than the gap 520. The sub-component further comprises a second gauge ring 524 comprising a fourth side wall 526 and defining a third circumferential groove 528. In the run in condition, the second side wall 508 and the fourth side wall 526 are separated by a gap substantially equal to the gap 520. The second ridge 510 projects from the second wall 508 by a distance substantially equal to the gap 520. The depth of the third groove 528 is substantially equal to the depth 522.

The first side wall 504 slopes towards the first gauge ring 514 and the second side wall 508 slopes towards the second gauge ring 524 from an inner diameter to an outer diameter of the packing element 502. The third side wall 516 and the fourth side wall 526 slope away from the packing element 502 from an inner diameter to an outer diameter of the gauge ring 514, 524, respectively. In the detail view, a portion of the sub-component 500 is shown in the compressed and/or deployed condition. The packing element 502 is shown to be expanded. In this condition, the second ridge 510 is compressed by an amount that depends on the difference between the gap 520 and the depth 522, thereby promoting increased sealing effectiveness. In some contexts, the ridges 506, 510 may be said to establish designed enhanced contact pressure zones when engaged with the grooves 518, 528. One skilled in the art will appreciate that much of the description of packing elements and gauge rings above applies substantially to the sub-component 500.

Figure 5F:
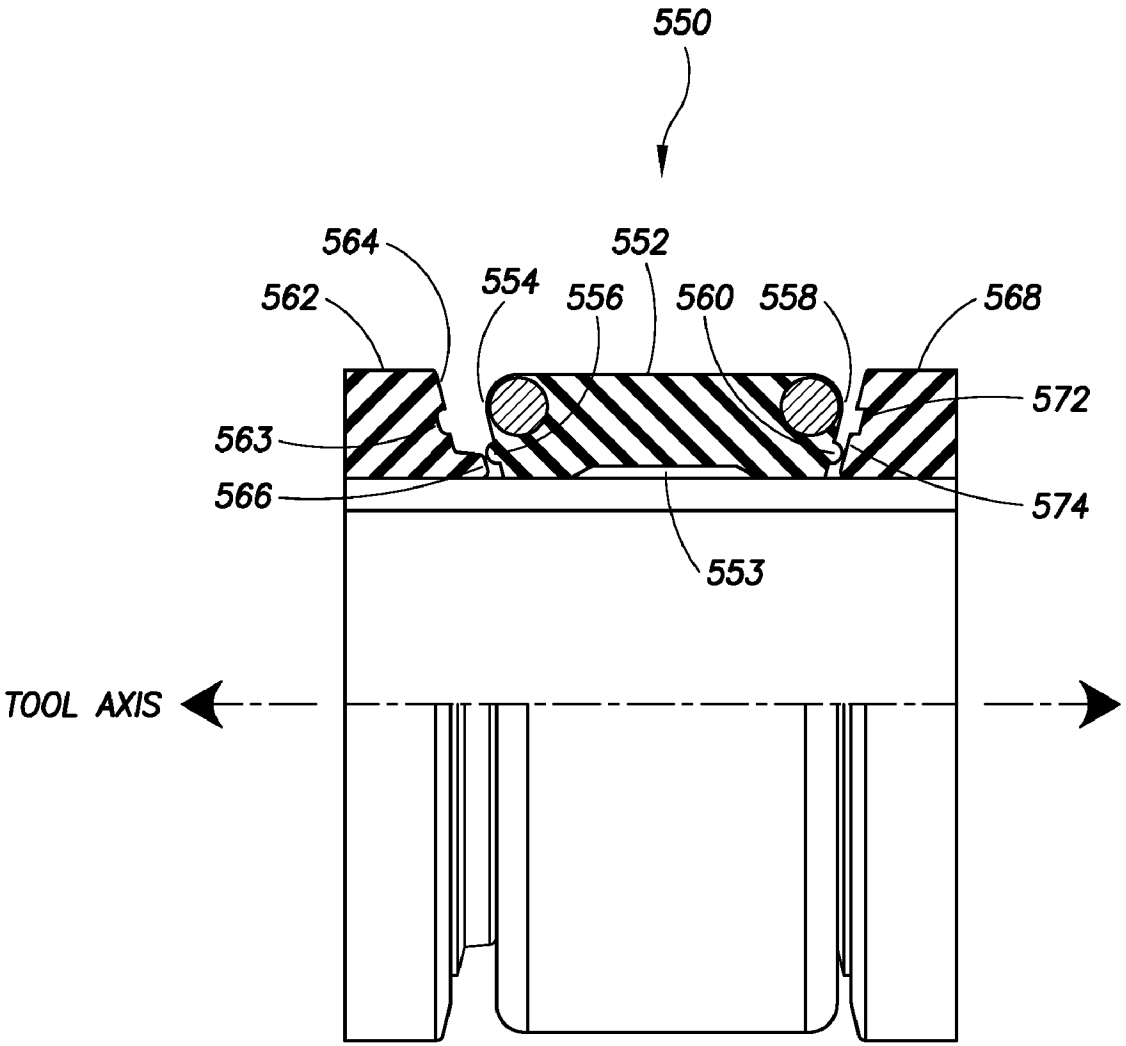
FIG. 5F is an illustration of a packing element in axial section view according to an embodiment of the disclosure.

With reference to FIG. 5F, an isolation tool sub-component 550 is shown. The sub-component 550 comprises a packing element 552 defining a first circumferential groove 553 and having a first side wall 554 comprising a first circumferential ridge 556 and a second side wall 558 comprising a second circumferential ridge 560. The sub-component 500 further defines a first gauge ring 562. The first gauge ring 562 defines a second circumferential groove 563 and comprises a third side wall 564 and a circumferential ramp 566. The sub-component further comprises a second gauge ring 568 comprising a fourth side wall 570 and defining a third circumferential groove 572. The ramp 566 promotes enhanced expansion of the packing element 552 proximate to the first side wall 554. In some contexts, the ridges 556, 560 may be said to establish designed enhanced contact pressure zones when engaged with the grooves 563, 572. With the exception of the ramp 566, the description of the sub-component 500 substantially applies to the sub-component 550.

Turning now to FIG. 6A, FIG. 6B, FIG. 6C, and FIG. 6D, two embodiments of packing elements 102 that provide for designed flow by of formation fluid and/or formation gas to an inner diameter of the packing element 102 to provide at least part of the actuation force for sealing between the packing element 102 and a casing wall are described. While for purposes of being concise only two example packing elements are described in detail below, a symmetrical packing element and an asymmetrical packing element, it is understood that many of features of the controlled contact surface embodiments described above can be combined with these two example packing elements to produce alternative embodiments of the disclosure.

Figure 6B:
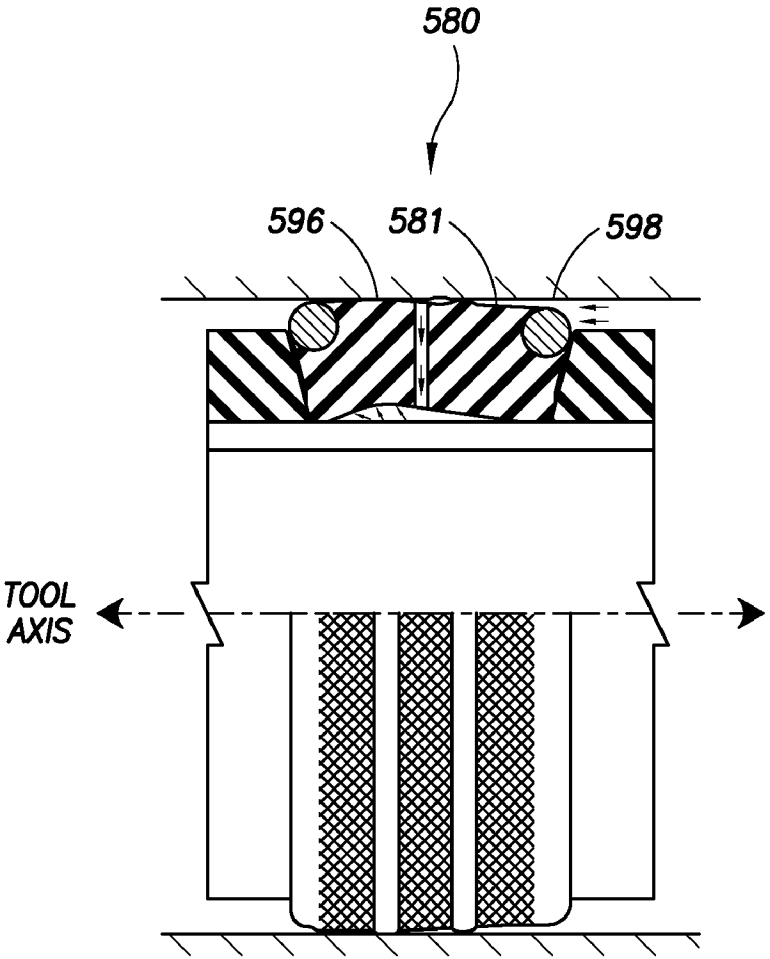
FIG. 6B is an illustration of the packing element of FIG. 6A in an activated condition according to an embodiment of the disclosure.
Figure 6A:
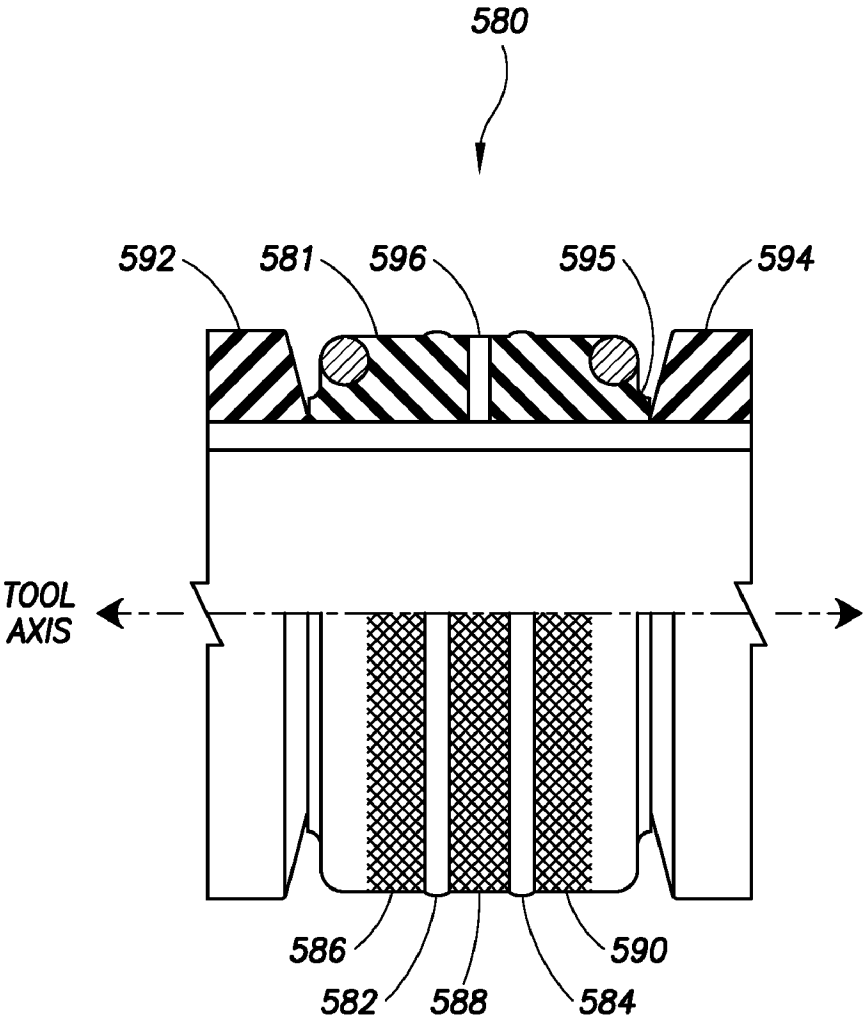
FIG. 6A is an illustration of a packing element in axial section view according to an embodiment of the disclosure.

Referring to FIG. 6A, an isolation tool sub-component 580 is shown comprising a packing element 581, a first gauge ring 592, and a second gauge ring 594. The packing element 581 comprises a first circumferential land 582 and a second circumferential land 584. The packing element 581 may share features of the packing element 102 described more fully above and may be used in the place of the packing element 102 in the tool 100 described above with reference to FIG. 1A. The packing element 581 is disposed concentric with the mandrel 104. The packing element 581 is at least partially flexible and swells when compressed. In an embodiment, the packing element 581 may comprise an elastomer or a plurality of elastomers. In an embodiment, the packing element 581 comprises materials such as those described further above with reference to the packing element 102. The packing element 581 defines a first circumferential knurled surface area 586, a second circumferential knurled surface area 588, a third circumferential knurled surface area 590, and a vent hole 596. The vent hole 596 provides communication from an outside diameter to an inside diameter of the packing element 581. While a single vent hole 596 is depicted in FIG. 6A, it is understood that the packing element 581 may define a plurality of vent holes substantially similar to vent hole 596. The packing element 581 further defines two circumferential ridges 595 on side walls facing the gauge rings 592, 594.

Referring to FIG. 6B, the isolation tool sub-component 580 is shown in an activated condition. The packing element 581 is shown expanded in outside diameter and reduced in axial length in response to compression between the gauge rings 592, 594. The two circumferential ridges 595 provide areas of increased contact pressure with the gauge rings 592, 594, thereby providing enhanced sealing from an inner diameter of the packing element 581 and an outer diameter at the junction of the gauge rings 592, 594 with the side walls of the packing element 581. As illustrated in FIG. 6B, the packing element 581 is subjected to a pressure differential directed from right to left (i.e., the pressure on the right of the packing element 581 is greater than the pressure on the left of the packing element 581). Formation fluid and or formation gas may flow over the third knurled surface area 590, past the second land 584, over the second knurled surface area 588, through the vent hole 596, to an inner diameter of the packing element 581. The pressure differential between the inner diameter of the packing element 581 and the annulus to the left of the packing element 581 applies force to increase the contact pressure between the first land 582 and the casing wall 598 at position 596 on the surface of the packing element 581, thereby increasing the effectiveness of the seal of the isolation tool sub-component 580. Because the packing element 581 is symmetrical, the packing element 581 may seal substantially equally well for a pressure differential directed from right to left and for a pressure differential directed from left to right.

Figure 6D:
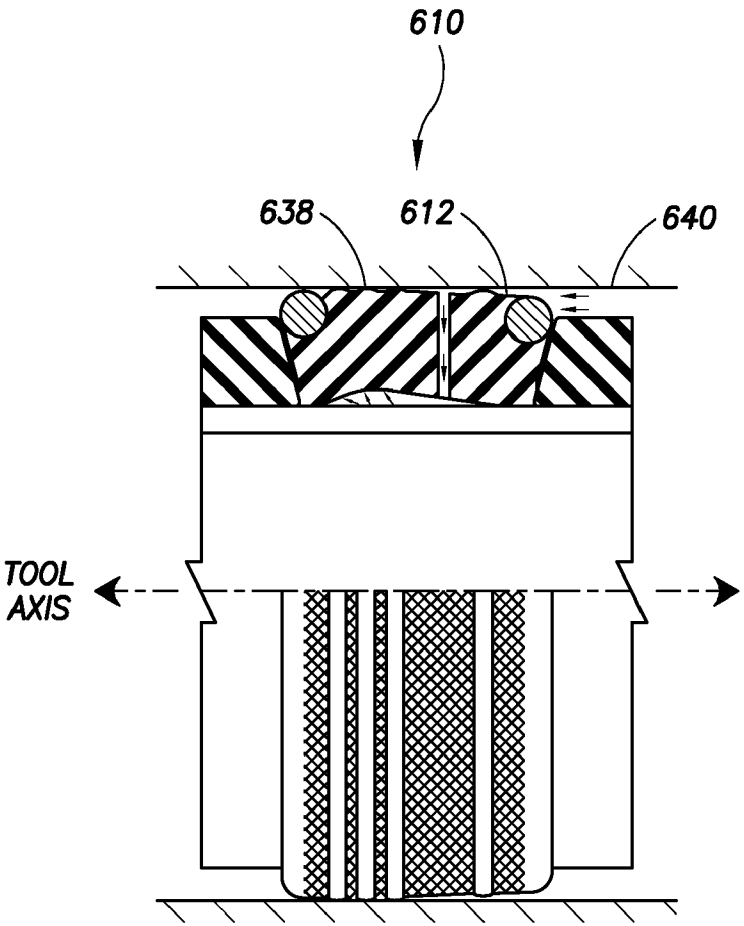
FIG. 6D is an illustration of the packing element of FIG. 6C in an activated condition according to an embodiment of the disclosure.
Figure 6C:
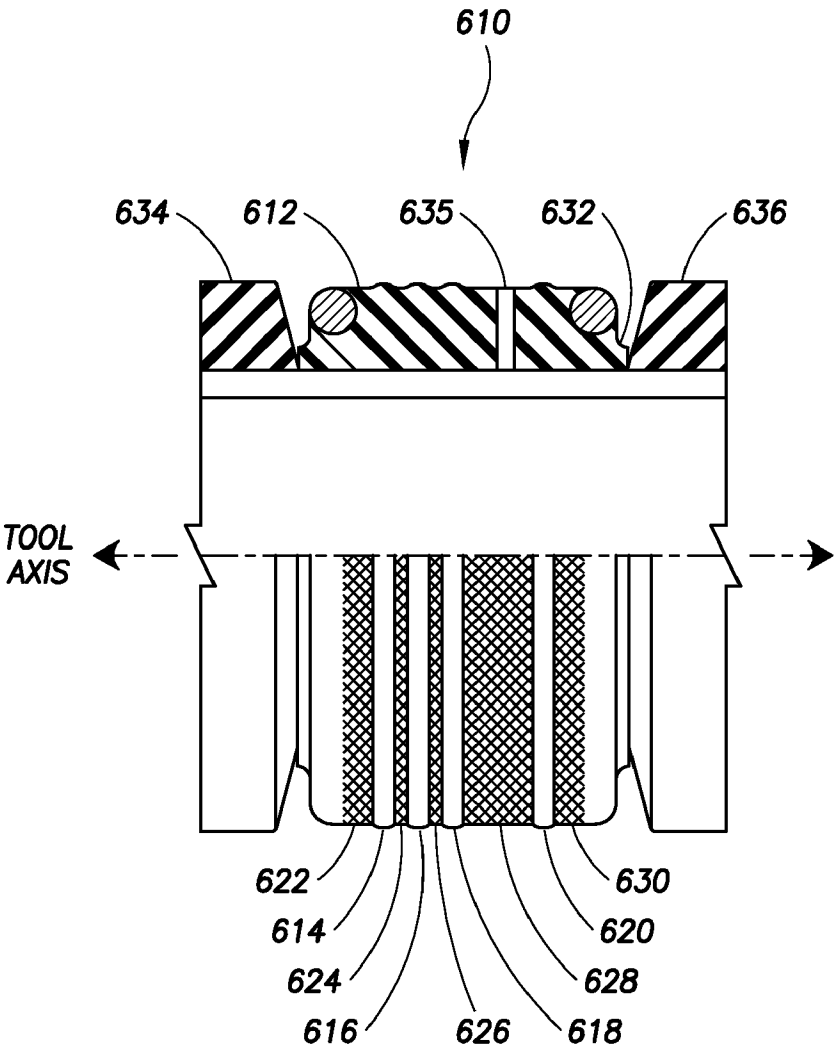
FIG. 6C is an illustration of a packing element in axial section view according to an embodiment of the disclosure.

Referring to FIG. 6C, an isolation tool sub-component 610 is shown comprising a packing element 612, a first gauge ring 634, and a second gauge ring 636. The packing element 612 comprises a first circumferential land 614, a second circumferential land 616, a third circumferential land 618, and a fourth circumferential land 620. The packing element 612 may share features of the packing element 102 described more fully above and may be used in the place of the packing element 102 in the tool 100 described above with reference to FIG. 1A. The packing element 612 is disposed concentric with the mandrel 104. The packing element 612 is at least partially flexible and swells when compressed. In an embodiment, the packing element 612 may comprise an elastomer. In an embodiment, the packing element 612 comprises materials such as those described further above with reference to the packing element 102. The packing element 612 defines a first circumferential knurled surface area 622, a second circumferential knurled surface area 624, a third circumferential knurled surface area 626, a fourth circumferential knurled surface area 628, a fifth circumferential knurled surface area 630, and a vent hole 635. The vent hole 635 provides communication from an outside diameter to an inside diameter of the packing element 612. While a single vent hole 635 is depicted in FIG. 6C, it is understood that the packing element 612 may define a plurality of vent holes substantially similar to vent hole 635. The packing element 612 further defines two circumferential ridges 632 on side walls facing gauge rings 634, 636.

Referring to FIG. 6D, the isolation tool sub-component 610 is shown in an activated condition. The activation and sealing of the isolation tool sub-component 610 is substantially similar to the activation and sealing of the isolation tool sub-component 580 described in detail with reference to FIG. 6B above. Because the packing element 612 is asymmetrical, however, it is preferable that the isolation tool sub-component 610 be deployed in a wellbore where it is expected that the pressure differential across the packing element 612 will conform to the sense illustrated in FIG. 6D.

In an embodiment, one or more of the controlled surface contact area features described above may be combined in the packing element 102. In an embodiment, one or more of the packing elements 260, 270, 280, 300, 320, 330, 340, 372, 402, 422, 452, 502, or 552 may comprise through holes and/or vent holes providing communication between the inner surface and the outer surface of the subject packing element. Other combinations of the many disclosed features are contemplated by the present disclosure. One or more of the controlled surface contact area features of the embodiments described above may be employed in packing elements 102 having asymmetrical design features. For example, a longitudinal center of the region of grooves and lands of the embodiments shown in FIG. 2A, FIG. 2B, FIG. 2C, FIG. 2D, FIG. 2E, and FIG. 6A may be displaced from a longitudinal center of the subject packing element 102 and hence may be an asymmetric packing element 102. For example, in an embodiment, one or more of the packing elements 260, 270, 280, 300, 320, 330, 340, 372, 402, 422, 452, 502, 552, 581, 612, 700, 720 may be comprised of sections of varying hardness, and hence may be an asymmetric packing element 102. For further details of the use of asymmetrical packing element design elements in dual directional removable isolation tools, see U.S. patent application Ser. No. 12/758,411 filed Apr. 12, 2010, titled "Sequenced Packing Element System," by James Crabb, which is hereby incorporated by reference for all purposes.

Figure 7:
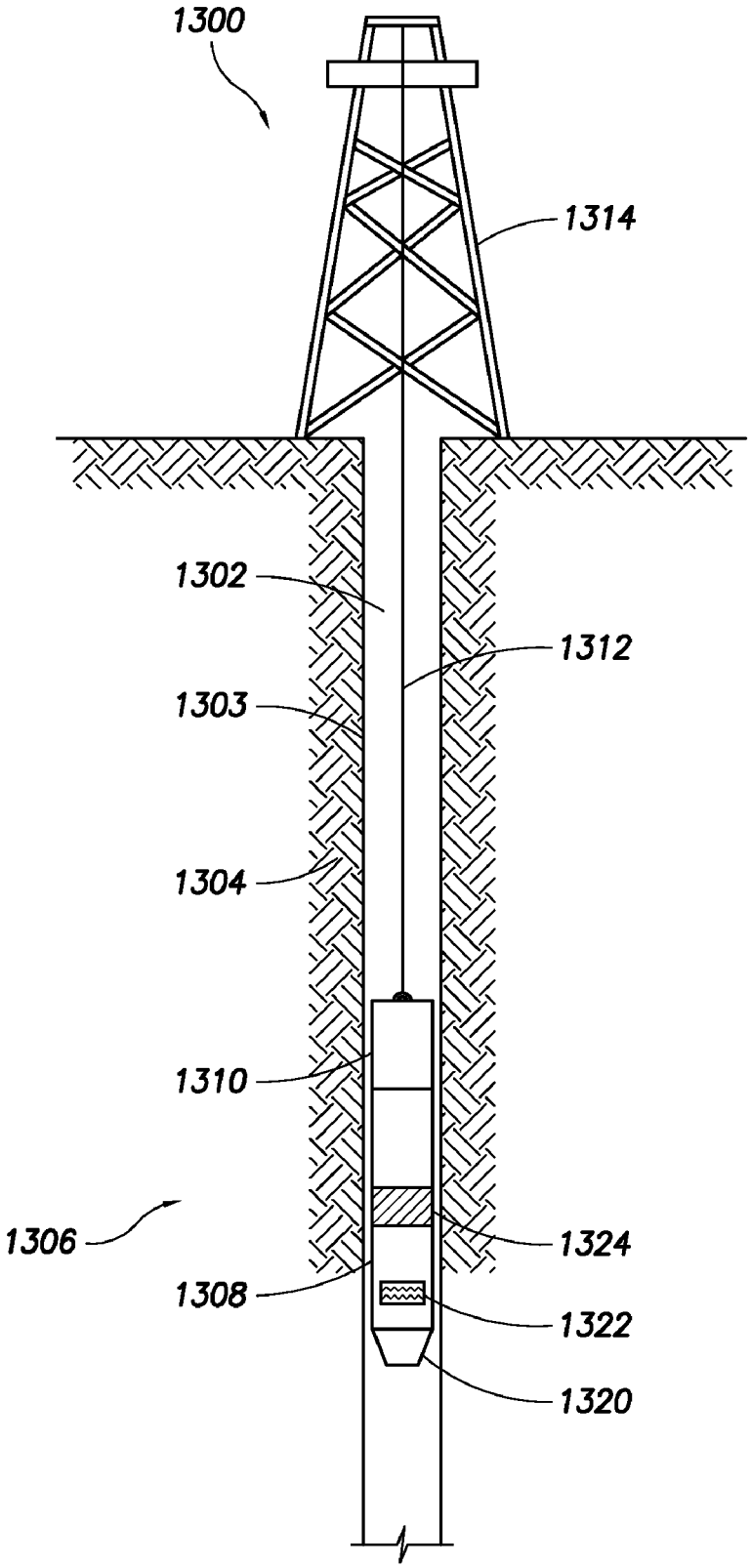
FIG. 7 is an illustration of a wellbore servicing system according to an embodiment of the disclosure.

Turning now to FIG. 7, a wellbore servicing system 1300 is described. The system 1300 comprises a servicing rig 1314 that extends over and around a wellbore 1302 that penetrates a subterranean formation 1304 for the purpose of recovering hydrocarbons, storing hydrocarbons, disposing of carbon dioxide, or the like. The wellbore 1302 may be drilled into the subterranean formation 1304 using any suitable drilling technique. While shown as extending vertically from the surface in FIG. 7, in some embodiments the wellbore 1302 may be deviated, horizontal, and/or curved over at least some portions of the wellbore 1302. Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. While in FIG. 7, the wellbore 1302 is illustrated as being cased with casing 1303, the wellbore 1302 may be cased, contain tubing, and may generally comprise a hole in the ground having a variety of shapes and/or geometries as is known to those of skill in the art.

The servicing rig 1314 may be one of a drilling rig, a completion rig, a workover rig, a servicing rig, or other mast structure and supports a toolstring 1306 and a conveyance 1312 in the wellbore 1302, but in other embodiments a different structure may support the toolstring 1306 and the conveyance 1312, for example an injector head of a coiled tubing rigup. In an embodiment, the servicing rig 1314 may comprise a derrick with a rig floor through which the toolstring 1306 and conveyance 1312 extends downward from the servicing rig 1314 into the wellbore 1302. In some embodiments, such as in an off-shore location, the servicing rig 1314 may be supported by piers extending downwards to a seabed. Alternatively, in some embodiments, the servicing rig 1314 may be supported by columns sitting on hulls and/or pontoons that are ballasted below the water surface, which may be referred to as a semi-submersible platform or rig. In an off-shore location, a casing may extend from the servicing rig 1314 to exclude sea water and contain drilling fluid returns. It is understood that other mechanical mechanisms, not shown, may control the run-in and withdrawal of the toolstring 1306 and the conveyance 1312 in the wellbore 1302, for example a draw works coupled to a hoisting apparatus, a slickline unit or a wireline unit including a winching apparatus, another servicing vehicle, a coiled tubing unit, and/or other apparatus.

The toolstring 1306 may comprise one or more downhole tools, for example a retrievable bridge plug 1308 and a setting tool 1310. Alternatively, the toolstring 1306 may comprise a different downhole tool, for example a retrievable packer. In some contexts, the retrievable bridge plug 1308 may be referred to as a down hole dual directional isolation tool or a downhole wireline retrievable dual directional isolation tool, and having a lower end 1320. In some contexts, the lower end 1320 may be referred to as a bull plug. The conveyance 1312 may be any of a string of jointed pipes, a slickline, a coiled tubing, a wireline, and other conveyances for the toolstring 1306. In another embodiment, the toolstring 1306 may comprise additional downhole tools located above or below the retrievable bridge plug 1308. Additionally, the toolstring 1306 may not include the retrievable bridge plug 1308 but may include instead an alternate dual directional isolation tool. In an embodiment, the toolstring 1306 may include one or more of a retrievable packer assembly, a retrievable straddle packer assembly, and/or other packer assemblies or packer subassemblies. It is contemplated that any of these packers, bridge plugs, and/or zonal isolation plugs may comprise a packing element incorporating one or a combination of the novel packing element structures described in detail above.

The toolstring 1306 may be coupled to the conveyance 1312 at the surface and run into the wellbore casing 1303, for example a wireline unit coupled to the servicing rig 1314 may run the toolstring 1306 that is coupled to a wireline into the wellbore casing 1303. In an embodiment, the conveyance may be a wireline, an electrical line, a coiled tubing, or other conveyance. The toolstring 1306 may be run past the target depth and retrieved to approximately the target depth, for example to assure that the toolstring 1306 reaches target depth. At target depth, the setting tool 1310 may be activated to set the retrievable bridge plug 1308 in the wellbore casing 1303. The setting tool 1310 may activate in response to a signal sent from the surface and/or in response to the expiration of a timer incorporated into the setting tool 1310.

In an embodiment, the setting tool 1310 may capture or grip an inner mandrel of the retrievable bridge plug 1308 and apply compression force to a sleeve structure operable to slide over the inner mandrel, for example the compressor ring 108 of FIG. 1. The compression force first causes slips 1322 of the retrievable bridge plug 1308 to deploy and engage the wellbore casing 1303. As the setting tool 1310 continues to increase the application of compression force, a packing element 1324 of the retrievable bridge plug 1308 expands. In an embodiment, such as that described above with reference to FIG. 6A and/or FIG. 6B, a pressure differential may contribute to energizing the seal between the packing element 1324 and the wellbore casing 1303. In an embodiment, enhanced sealing effectiveness is achieved by reducing a contact surface area of the packing element 1324 where it engages the casing 1303 or through the use of designed enhanced contact pressure zones in the retrievable bridge plug 1308.

After fully deploying the packing element 1324, continued application of compression force by the setting tool 1310 may cause a latching mechanism of the retrievable bridge plug 1308 to latch the compression forces loaded into the packing element 1324. For example, the compressor ring 108 of FIG. 1A may be latched to hold the applied compression forces. Further application of compression force by the setting tool 1310 may cause a coupling mechanism coupling the setting tool 1310 to the retrievable bridge plug 1308 to shear, decouple, and/or release, thereby allowing withdrawal of the setting tool 1310 from the wellbore 1302.

The retrievable bridge plug 1308 may be placed in the wellbore casing 1303 to serve a variety of purposes. The retrievable bridge plug 1308 may be installed above the uppermost production zone to seal the upper end of the wellbore casing 1303, to temporarily stop ring production, in order to remove a wellhead, also referred to as a Christmas tree, to replace or service the wellhead. After reinstallation of the wellhead, the retrievable bridge plug 1308 may be retrieved from the wellbore casing 1303. The retrievable bridge plug 1308 may be placed in the wellbore casing 1303 to seal off non-producing formations below the lowermost production zone, thus isolating the lowermost production zone from the remaining wellbore 1302 below production. The retrievable bridge plug 1308 may be placed in the wellbore casing 1303 above the uppermost production zones to suspend production, for example temporary well abandonment. The retrievable bridge plug 1308 may be placed in the wellbore casing 1303 to test tubing. The retrievable bridge plug 1308 may be placed in the wellbore casing 1303 to promote setting of a completion packer. Those skilled in the art will appreciate that yet other applications of the retrievable bridge plug 1308 are contemplated by the present disclosure and may advantageously employ the packing element 102, 1324 taught by the present disclosure.

To retrieve the retrievable bridge plug 1308, a retrieval tool (not shown) may be run into the wellbore 1302 on the conveyance 1312 to the retrievable bridge plug 1308 where the retrieval tool may couple to the retrievable bridge plug 1308. The service rig 1314 may exert upwards force on the conveyance 1312 until a shear pin, shear screw, shear ring and/or other decoupling device in the retrievable bridge plug 1308 securing the latching mechanism shears or otherwise releases. With the latching mechanism thus released, the packing element 1324 relaxes and disengages from the wellbore casing 1303. After the release of the packing element 1324, further exertion of upwards force on the conveyance 1312 by the service rig 1314 may cause the slips 1322, that may be spring loaded to the retracted position, to retract, thereby releasing the retrievable bridge plug 1308 from the wellbore casing 1303. The retrievable bridge plug 1308 may then be retrieved completely from the wellbore 1302.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A downhole retrievable dual directional isolation tool, comprising:

a mandrel;

a compressor ring concentric with the mandrel; and a packing element concentric with the mandrel and having an outer surface defining a plurality of grooves, wherein the packing element comprises elastomeric material, wherein the grooves are curved or rectangular in cross section, wherein the grooves are disposed circumferentially around the packing element, and wherein the grooves are disposed asymmetrically with respect to a centered longitudinal axis of the packing element.

2. The tool of claim 1, wherein the grooves define a knurled pattern or a latticed pattern.

3. The tool of claim 1, wherein the packing element further comprises a vent hole passing from the outside of the packing element to the inside of the packing element.

4. The tool of claim 1, wherein the packing element further comprises at least one groove in an inner surface of the packing element, whereby in a set state of the tool formation fluid pressure or formation gas pressure enters the groove on the inner surface of the packing element and activates a contact pressure between the packing element outer surface and a casing wall.

5. A downhole retrievable dual directional isolation tool, comprising:

a mandrel;

a packing element concentric with the mandrel, wherein the packing element comprises elastomeric material;

a compressor ring concentric with the mandrel and having a first side wall proximate to a second side wall of the packing element; and a stop ring concentric with the mandrel having a third side wall proximate to a fourth side wall of the packing element, wherein the first side wall of the compressor ring or the third side wall of the stop ring comprise two circumferential lands, whereby in a set state of the tool a contact area between the circumferential lands and the second side wall of the packing element or the fourth side wall of the packing element achieves higher contact pressure, and wherein the two circumferential lands in the first side wall of the compressor ring define a first groove between them and the packing element has a first ridge in the second side wall that protrudes a distance that is greater than the depth of the first groove or the two circumferential lands in the third side wall of the stop ring define a second groove between them and the packing element has a second ridge in the fourth side wall that protrudes a distance that is greater than the depth of the second groove.

6. The tool of claim 5, wherein the first ridge and the first groove are unaligned in an unset state of the tool and mated in a set state of the tool or the second ridge and the second groove are unaligned in the unset state of the tool and mated in the set state of the tool.

7. The tool of claim 5, wherein the first side wall of the compressor ring or the third side wall of the stop ring comprises a circumferential ramp proximate to the inner surface of the compressor ring or the stop ring.

8. The tool of claim 5, wherein the packing element comprises an anti-extrusion mechanism.

9. The tool of claim 5, wherein the packing element has an outer surface defining a plurality of grooves.

10. The tool of claim 9, wherein the grooves are disposed asymmetrically with respect to a centered longitudinal axis of the packing element.

11. The tool of claim 9, wherein the packing element further comprises at least one groove in an inner surface of the packing element.

12. A downhole retrievable dual directional isolation tool, comprising:

a mandrel;

a packing element comprising elastomeric material and having an outer surface defining a plurality of circumferential grooves, wherein the grooves are angled across an axial section of the packing element, wherein a first set of the grooves are disposed on a first side of a longitudinal land of the packing element and a second set of grooves are disposed on a second side of the longitudinal land of the packing element, and wherein the first set of grooves and the second set of grooves angle towards the longitudinal land from an inner diameter to an outer diameter of the packing element and wherein the first and second set of grooves are disposed asymmetrically with respect to a centered longitudinal axis of the packing element.

13. The tool of claim 12, wherein the packing element further comprises an anti-extrusion mechanism.

14. A downhole retrievable dual directional isolation tool, comprising:

a mandrel;

a compressor ring concentric with the mandrel; and a packing element concentric with the mandrel and having an outer surface defining a plurality of grooves disposed circumferentially around the packing element and disposed asymmetrically with respect to a centered longitudinal axis of the packing element.

15. The tool of claim 14, wherein the packing element further comprises a vent hole passing from the outside of the packing element to the inside of the packing element.

16. The tool of claim 14, wherein the packing element further comprises at least one groove in an inner surface of the packing element, whereby in a set state of the tool formation fluid pressure or formation gas pressure enters the groove on the inner surface of the packing element and activates a contact pressure between the packing element outer surface and a casing wall.

17. The tool of claim 14, wherein the compressor ring has a first side wall proximate to a second side wall of the packing element, further comprising:

a stop ring concentric with the mandrel and having a third side wall proximate to a fourth side wall of the packing element, wherein the first side wall of the compressor ring or the third side wall of the stop ring have a circumferential land that is round or rectangular in cross section, whereby in a set state of the tool a contact area between the circumferential land and the second side wall of the packing element or the fourth side wall of the packing element achieves higher contact pressure, wherein the first side wall of the compressor ring has two circumferential lands defining a first groove between them and the packing element has a first ridge in the second side wall that protrudes a distance that is greater than the depth of the first groove or the third side wall of the stop ring has two circumferential lands defining a second groove between them and the packing element has a second ridge in the fourth side wall that protrudes a distance that is greater than the depth of the second groove.

18. The tool of claim 17, wherein the first ridge and the first groove are unaligned in an unset state of the tool and mated in a set state of the tool or the second ridge and the second groove are unaligned in the unset state of the tool and mated in the set state of the tool.

19. The tool of claim 14, wherein the packing element is comprised of elastomeric material.

20. The tool of claim 14, wherein the packing element comprises an anti- extrusion mechanism.

21. A downhole retrievable dual directional isolation tool, comprising:

a mandrel;

a compressor ring concentric with the mandrel; and a packing element concentric with the mandrel and having an outer surface defining a plurality of grooves, wherein the packing element comprises elastomeric material, wherein the grooves are curved or rectangular in cross section, wherein the grooves are disposed asymmetrically with respect to a centered longitudinal axis of the packing element, and wherein the packing element comprises a vent hole passing from the outside of the packing element to the inside of the packing element.

22. The tool of claim 21, wherein the grooves are disposed circumferentially around the packing element.

23. The tool of claim 22, wherein the packing element comprises an anti-extrusion mechanism.

24. A downhole retrievable dual directional isolation tool, comprising:

a mandrel;

a compressor ring concentric with the mandrel; and a packing element concentric with the mandrel and having an outer surface defining a plurality of grooves, wherein the packing element comprises elastomeric material, wherein the grooves are curved or rectangular in cross section, wherein the grooves are disposed asymmetrically with respect to a centered longitudinal axis of the packing element, and wherein the packing element comprises at least one groove in an inner surface of the packing element, whereby in a set state of the tool formation fluid pressure or formation gas pressure enters the groove on the inner surface of the packing element and activates a contact pressure between the packing element outer surface and a casing wall.

25. The tool of claim 24, wherein the grooves defined by the outer surface are disposed circumferentially around the packing element.

26. The tool of claim 25, wherein the packing element comprises an anti-extrusion mechanism.

* * * * *